US012692066B2

(12) United States Patent
Yasuda

(10) Patent No.: US 12,692,066 B2
(45) Date of Patent: Jul. 28, 2026

(54) PACKING MEMBER

(71) Applicant: KONICA MINOLTA, INC., Tokyo (JP)

(72) Inventor: Keiko Yasuda, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 18/679,280

(22) Filed: May 30, 2024

(65) Prior Publication Data

US 2024/0409302 A1 Dec. 12, 2024

(30) Foreign Application Priority Data

Jun. 6, 2023 (JP) ..... 2023-093015

(51) Int. Cl.
*B65D 85/68* (2006.01)
*B65D 81/38* (2006.01)

(52) U.S. Cl.
CPC ..... *B65D 85/68* (2013.01); *B65D 81/3813* (2013.01); *B65D 2203/12* (2013.01); *B65D 2585/689* (2013.01)

(58) Field of Classification Search
CPC .... B65D 85/68; B65D 81/3813; B65D 25/02; B65D 25/2802; B65D 2203/12; B65D 2585/689; B41J 2/1752; B41J 2/17559; B41J 2/17533; G03G 15/2003; G03G 15/2064; G03G 15/2053; G03G 15/80
(Continued)

(56) References Cited

U.S. PATENT DOCUMENTS 3,565,243 A * 2/1971 Freeman ..... B65D 81/113 217/53
4,094,212 A * 6/1978 Hyams ..... H01H 85/547 294/131

(Continued)

FOREIGN PATENT DOCUMENTS

JP H04116678 A 4/1992
JP H0644766 U * 6/1994

(Continued)

OTHER PUBLICATIONS

Office Action dated Mar. 18, 2026, for Chinese Patent Application No. 202410715973.7, with English translation, 17 pages.

*Primary Examiner* — Orlando E Aviles
*Assistant Examiner* — Brijesh V. Patel
(74) *Attorney, Agent, or Firm* — Squire Patton Boggs (US) LLP

(57) ABSTRACT

A packing member packs a fixing device which is detachable from and attachable to an image forming apparatus. The packing member allows a user to grip the fixing device by being interposed between the fixing unit mounted on the image forming apparatus and the user. The packing member includes a cover part covering the fixing device, and a left gripping part and a right gripping part which are provided as a pair in the left and right of the cover part and grip a gripped part formed in the fixing device. The left gripping part and the right gripping part have a heat insulator insulating heat between an inner surface and an outer surface. The inner surface is attached to the gripped part under pressure by applying pressing force to the outer surface.

19 Claims, 17 Drawing Sheets

(58) Field of Classification Search
USPC ..... 206/320, 590–592, 586–588, 594, 485, 206/521, 576, 722, 453; 399/262, 111, 399/107; 493/137, 55, 967–968; 53/397, 53/472–473; 229/87.02, 120.37
See application file for complete search history.

(56) References Cited

U.S. PATENT DOCUMENTS 4,759,446 A * 7/1988 Dobashi ..... B65D 77/30 53/399
5,131,539 A * 7/1992 Karita ..... B41J 2/17533 D18/56
5,231,416 A * 7/1993 Terasawa ..... B41J 2/1714 346/146
5,322,168 A * 6/1994 Kataoka ..... B65D 5/5035 206/583
5,341,934 A * 8/1994 Hsu ..... B65D 81/05 206/521
5,398,808 A * 3/1995 Chen ..... B65D 5/5071 206/320
5,742,883 A * 4/1998 Girard ..... G03G 21/181 229/92.8
5,755,331 A * 5/1998 Watson ..... B65D 81/05 206/320
D395,234 S * 6/1998 Shida ..... D9/423
5,772,025 A * 6/1998 Chen ..... B65D 81/05 206/320
5,806,683 A * 9/1998 Gale ..... B65D 81/025 206/592
5,816,409 A * 10/1998 Baker ..... B65D 21/0233 206/592
5,826,726 A * 10/1998 Yang ..... B65D 81/057 206/592
5,871,097 A * 2/1999 Shida ..... B65D 81/30 206/521
5,979,659 A * 11/1999 Kataoka ..... B65D 5/5071 206/320
6,092,651 A * 7/2000 Miller ..... B65D 81/113 206/521
6,268,039 B1 * 7/2001 Chou ..... B65D 5/5069 206/583
6,283,587 B1 * 9/2001 Umemura ..... B41J 2/17533 347/86
6,405,873 B2 * 6/2002 Koike ..... B65D 81/025 206/592
6,431,362 B1 * 8/2002 Araki ..... G03G 15/0896 206/588
6,502,701 B2 * 1/2003 Shinada ..... B65D 81/025 206/723
6,685,025 B1 * 2/2004 Kari ..... B65D 5/5069 206/583
6,843,374 B1 * 1/2005 Li ..... B65D 5/5069 206/587
7,021,024 B2 * 4/2006 Kari ..... B65D 5/5069 493/137
7,278,249 B2 * 10/2007 Kari ..... B65D 5/5069 493/137
7,328,800 B2 * 2/2008 Koike ..... B65D 5/58 206/592
7,364,039 B2 * 4/2008 Katsuyama ..... B41J 2/17553 206/320
7,424,954 B2 * 9/2008 Otsuka ..... B65D 81/113 206/320
7,424,955 B2 * 9/2008 Chen ..... B65D 5/5069 206/320
7,494,013 B2 * 2/2009 Kao ..... B65D 5/5069 206/592
7,636,529 B2 * 12/2009 Kamimura ..... G03G 15/0894 206/320
7,703,608 B2 * 4/2010 Hsu ..... B41J 2/17553 206/592
7,754,310 B2 * 7/2010 Kuo ..... B65D 81/055 428/122
7,780,010 B2 * 8/2010 Kinuhata ..... B65D 5/504 53/462
7,813,671 B2 * 10/2010 Nittani ..... G03G 21/1821 399/113
7,856,192 B2 * 12/2010 Koishi ..... G03G 21/1871 399/113
7,992,715 B2 * 8/2011 Kwon ..... G03G 15/0855 206/320
8,016,109 B2 * 9/2011 Liang ..... B65D 81/05 206/521
8,017,215 B2 * 9/2011 Kuo ..... B65D 81/058 428/122
8,215,484 B2 * 7/2012 Lim ..... B65D 81/058 206/592
8,757,384 B2 * 6/2014 Ooi ..... B65D 5/5088 206/521
8,800,773 B2 * 8/2014 Inugai ..... B65D 77/0413 206/307
8,805,250 B2 * 8/2014 Takami ..... G03G 21/181 399/119
9,002,235 B2 * 4/2015 Hymas ..... B65D 81/022 399/109
9,321,575 B2 * 4/2016 Nakamura ..... B65D 5/5069
9,399,352 B2 * 7/2016 Mizutani ..... B41J 2/1753
9,517,872 B2 * 12/2016 Murano ..... B65D 77/04
9,563,151 B2 * 2/2017 Sato ..... G03G 15/0896
9,708,116 B2 * 7/2017 Koishi ..... B65D 43/16
9,834,357 B2 * 12/2017 Kawata ..... B65D 77/0433
10,248,047 B2 * 4/2019 Tamura ..... G03G 15/0863
10,294,003 B2 * 5/2019 Yamamura ..... G03G 21/181
10,692,679 B2 * 6/2020 Henricks ..... H01H 9/104
11,021,309 B2 * 6/2021 Nohara ..... B65D 81/05
2004/0232031 A1 * 11/2004 Nishi ..... B31D 5/0073 53/472
2005/0252815 A1 * 11/2005 Ahn ..... B65D 85/30 206/521
2006/0021902 A1 * 2/2006 Chen ..... B65D 81/02 206/586
2006/0102516 A1 * 5/2006 Ho ..... B65D 81/113 206/592
2007/0175778 A1 * 8/2007 Imai ..... B65D 5/5038 206/521
2007/0230997 A1 * 10/2007 Matsui ..... G03G 21/1828 399/111
2009/0139895 A1 * 6/2009 Li ..... B65D 5/5069 206/594
2010/0108702 A1 * 5/2010 Liu ..... B65D 5/5071 229/87.02
2011/0220542 A1 * 9/2011 Kuo ..... B65D 81/05 206/587
2012/0085678 A1 * 4/2012 Yoshida ..... B65D 5/509 206/592
2012/0144783 A1 * 6/2012 Nakamura ..... B65D 5/505 206/521
2015/0114870 A1 * 4/2015 Fujino ..... B65D 55/024 206/503
2015/0153708 A1 * 6/2015 Koishi ..... G03G 15/0865 399/110
2016/0060013 A1 * 3/2016 Hsu ..... B65D 81/1075 206/591
2017/0144819 A1 * 5/2017 Itano ..... B65D 81/133
2018/0273273 A1 * 9/2018 Takeuchi ..... B65D 81/133
2020/0277099 A1 * 9/2020 Wenner ..... B65D 5/5052
2022/0380109 A1 * 12/2022 Itano ..... B65D 81/057
2023/0264880 A1 * 8/2023 Sakai ..... B65D 81/025 206/590
2024/0025616 A1 * 1/2024 Wakimoto ..... B65D 5/5035

FOREIGN PATENT DOCUMENTS

JP H0676128 U * 10/1994
JP H08160729 A 6/1996
JP 2000016460 A * 1/2000
JP 2000199995 A * 7/2000

(56) References Cited

FOREIGN PATENT DOCUMENTS

| | | | | | |
|---|---|---|---|---|---|
| JP | 2002193334 | A | * | 7/2002 | |
| JP | 2003241615 | A | | 8/2003 | |
| JP | 2006168747 | A | | 6/2006 | |
| JP | 2008184198 | A | | 8/2008 | |
| JP | 2019012490 | A | | 1/2019 | |
| KR | 20080102093 | A | * | 11/2008 | ..... D21C 5/02 |
| WO | WO-2019176890 | A1 | * | 9/2019 | ..... B41J 2/17536 |
| WO | WO-2019177123 | A1 | * | 9/2019 | ..... B41J 2/17536 |
| WO | WO-2019177126 | A1 | * | 9/2019 | ..... B41J 2/17536 |

* cited by examiner

PACKING MEMBER

CROSS-REFERENCE TO RELATED APPLICATION

This application claims foreign priority to Japanese Patent Application No. 2023-093015. filed Jun. 6, 2023, the disclosure of which is incorporated herein by reference.

BACKGROUND OF THE INVENTION

Technical Field

The present invention relates to a packing member.

Description of Related art

An electrophotographic image forming apparatus, such as a multifunction machine, is provided with a fixing device for fixing a toner image onto a recording medium, such as a sheet. In such a configuration, a heater built in the fixing device generates heat. The fixing device pressurizes and heats the toner placed on the sheet to fix the toner as a toner image on the sheet surface. The fixing device is configured to be detachable from and attachable to the image forming apparatus. For example, a fixing device described in Patent Literature 1, Japanese Unexamined Patent Publication No. H 4-116678, is integrally provided with a knob. Then, the used fixing device is detached from the image forming apparatus by using the knob, and a new fixing device is attached to the image forming apparatus, whereby a replacement operation is performed. Furthermore, in an image forming apparatus described in Patent Literature 2, Japanese Unexamined Patent Publication No. 2019-12490, a cooling unit is provided and cooling wind is constantly sent to a handle of a fixing device to cool it.

SUMMARY OF THE INVENTION

Even when the temperature of the fixing device is still high, such as during continuous printing or immediately after the end of printing, there is a demand for replacing a used fixing device with a new fixing device and restarting the next printing early.

When a replacement work of the fixing device is performed, it is considered that a packing member packing the new fixing device is used for packing the used fixing device as it is and the used fixing device is transported. When the packing member is reused as mentioned, the packing member from which the new fixing device has been taken out and which has become empty can be used without being discarded. Conventionally, a used fixing device with a high-temperature is removed from an image forming apparatus after waiting for decrease of the temperature of the used fixing device, and the used fixing device removed from the image forming apparatus is packed in a packing member. Since it is necessary to wait until the temperature of the fixing device decreases, performing a replacement work takes time, and workability is not satisfactory. Further, the fixing device may be replaced not only by a service technician skilled in replacement works but also by an inexperienced user. In such a case, there is a possibility that a worker carelessly comes into contact with a fixing device, such as the worker holds the fixing device whose temperature is not sufficiently lowered. Furthermore, when a fixing device comes into contact with a hand or clothes of a worker, a toner of the fixing device may adhere to the hand or clothes and stain them, and thus the workability of the replacement is not satisfactory.

In a case where a cooling unit for cooling a fixing device is provided, there is a risk that the fixing device is always cooled by cooling wind and fixing performance of toner is influenced. Therefore, further improvement is desired so that easy and inexpensive replacement of a fixing device is enabled.

An object of the present invention is to provide a packing member capable of enhancing workability of a replacement of a fixing device while enhancing utility values.

Solutions to Problems

To achieve at least one of the abovementioned objects, according to an aspect of the present invention, a packing member reflecting one aspect of the present invention includes the following configurations.

(1) The present invention is a packing member for packing a fixing device detachable from and attachable to an image forming apparatus. The packing member allows a user to grip the fixing device mounted on the image forming apparatus by being interposed between the fixing device and the user.

(2) The packing member includes a cover part that covers the fixing device, and a gripping part that is provided at least a part of the cover part and grips a gripped part formed in the fixing device.

(3) The gripping part includes a heat insulator that insulates heat between an inner surface and an outer surface, and the inner surface is attached to the gripped part under pressure by applying pressing force to the outer surface.

(4) The packing member according to (3), wherein the heat insulator has a thermal conductivity $\lambda$[W/m·K] of less than 2.0.

(5) The packing member according to (3), wherein the heat insulator has a thermal conductivity $\lambda$[W/m·K] of less than 1.0.

(6) The packing member according to (3), wherein the heat insulator has a thermal conductivity $\lambda$[W/m·K] of less than 0.06.

(7) The packing member according to any one of (3) to (6), wherein the heat insulator is made of a pulp mold.

(8) The packing member according to (3), wherein a dimension between an inner surface of the gripping part and an outer wall of the gripped part is set to be smaller than a dimension between an inner surface of the cover part and an outer wall of the fixing device.

(9) The packing member according to (3), wherein a thickness dimension between an inner surface and an outer surface of the gripping part is set to be greater than a thickness dimension between an inner surface and an outer surface of the cover part.

(10) The packing member according to (2), wherein a pair of the gripping parts is provided so as to be separated from each other, and the cover part integrally connects between the gripping parts.

(11) The packing member according to (2), wherein a pair of the gripping parts is provided so as to be spaced apart from each other, and the cover part provided around one of the gripping part extends toward the other gripping part.

(12) The packing member according to (2), wherein the gripping part has a mark to be distinguished from other constituent parts.

(13) The packing member according to (12), wherein the mark is a finger placing recess section in a concave shape.

(14) The packing member according to (2), wherein the mark is a window section formed by cutting out a part of a flange part located outside the finger placing recess section.

(15) The packing member according to any one of (12) to (14), in which the mark is different from another parts in color, texture, or material.

(16) A packing member includes a first packing member to cover half or more of a fixing device in an attachment direction of the fixing device, and another member being separated from the first packing member in the attachment direction of the fixing device and covering a smaller part of the fixing device than the first packing member. The packing member according to (2), wherein the first packing member is provided with the gripping part at an intermediate position in an attachment direction of the fixing device.

DETAILED DESCRIPTION

Figure 1:
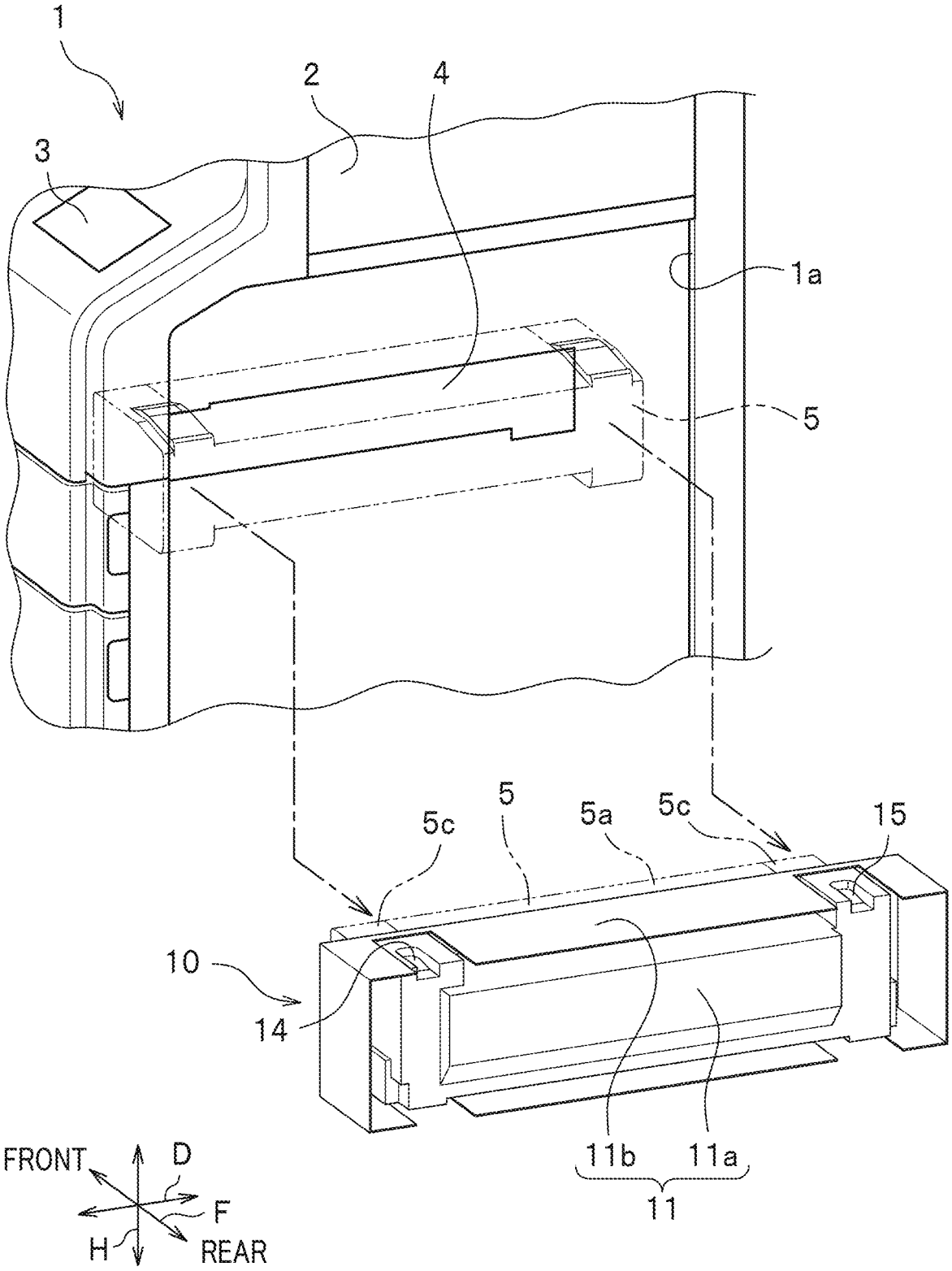
FIG. 1 is a perspective view illustrating how a fixing device in a heated state is detached from an image forming apparatus by using the packing member according to the embodiment 1 of the present invention.

Hereinafter, one or more embodiments of the present invention will be described with reference to the respective drawings. However, the invention is not limited to the disclosed embodiments. FIG. 1 illustrates a state in which the fixing device 5 is replaced using the packing member 10 in a state in which a side surface of the image forming apparatus 1 according to the present embodiment is opened. Note that in the embodiment, for easier understanding, an attachment direction F is defined such that a direction in which the fixing device 5 is attached to a side when the image forming apparatus 1 is viewed from front is front and a direction in which the fixing device 5 is detached is defined as rear. Further, in the embodiment, a height direction of the image forming apparatus 1 is defined as an up-down direction H. In the embodiment, a longitudinal direction of the fixing device 5, which is a depth direction of the image forming apparatus 1 orthogonal to the attachment direction F and the up-down direction H, is defined as a right-left direction D.

Image Forming Apparatus

The image forming apparatus 1 adopts an intermediate transfer method utilizing an electrophotographic process technology. The image forming apparatus 1 mainly includes an image reading section 2 that reads an image from an object to be copied such as a document, an operation panel 3 and a controller (not shown). The controller includes a central processing unit (CPU), a read only memory (ROM), a random access memory (RAM), and the like. The CPU reads a program relating to processing contents from the ROM and develops the program in the RAM. The CPU controls each section of the image forming apparatus 1 by cooperating the developed program and various data stored in a storage section such as a storage.

The image forming apparatus 1 forms a toner image from input image data read or input by the image reading section 2. The image forming apparatus 1 is provided with a fixing device 5 that pressurizes and heats the toner image placed on the conveyed recording media P to fix the toner image. Furthermore, a maintenance opening 1*a* is formed at a side part of the image forming apparatus 1. The maintenance opening 1*a* is provided with a cover body that is openable and closable. Inside the maintenance opening 1*a*, an attachment part 4 to which the fixing device 5 is installed as detachable and attachable is provided.

Fixing Device

Figure 2:
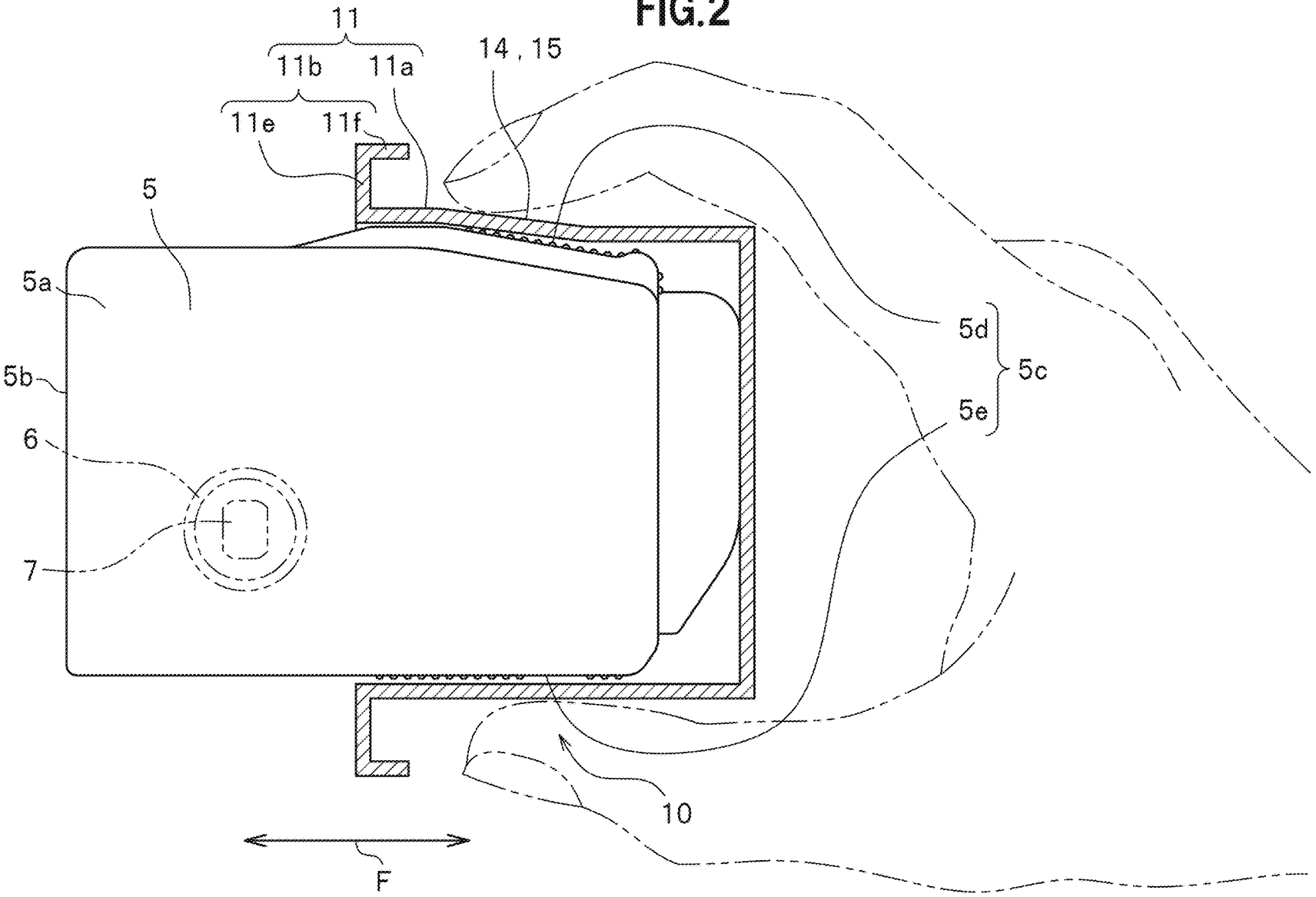
FIG. 2 is a side view illustrating a state in which the fixing device is gripped using the packing member.

As shown in FIG. 2, the fixing device 5 includes a housing 5*a* having a hollow and a substantially rectangular parallelepiped shape. The housing 5*a* includes a roller 6 and a heater 7 therein. The roller 6 is disposed in the axial direction or in a right-left direction (longitudinal direction) D of the housing 5*a*. The roller 6 is supported rotatably about the axis by hosing 5*a*. The fixing device 5 of the embodiment includes a heater 7 inside the roller 6. The heater 7 is energized to increase in temperature to heat the pressure surface of the roller 6, which is in contact with the recording media P. Next, the toner placed on the recording media P is pressed and heated by a pressure surface of the roller 6 that rolls, and is fixed as a toner image on the sheet surface. Note that a heater 7 may be provided outside the roller 6 so that the pressure surface of the roller 6 or the like is heated from the outside.

Furthermore, in the housing 5*a* of the fixing device 5, an attachment surface 5*b* is formed at a front end portion in the attachment direction F so as to face the attachment part 4. The attachment part 4 is provided inside the image forming apparatus 1. The attachment part 4 allows the fixing device 5 to be attached to and detached from the side in an attachment direction F in a state where a cover body provided in a side part of the image forming apparatus 1 is opened. For example, when a maintenance work is performed, the used fixing device 5 is removed from the image forming apparatus 1 and replaced with a new fixing device 5. When maintenance work is performed, the fixing device 5 attached to the attachment part 4 may be removed toward the rear in the attachment direction F by releasing an engagement of the attachment surface 5*b* to the attachment part 4.

Next, a new fixing device 5 to be replaced is oriented toward the front in the attachment direction F and the attachment surface 5*b* is engaged with the attachment part 4. Thus, the new fixing device 5 is attached to the inside of the image forming apparatus 1. The fixing device 5 is configured to be electrically connected to the controller when the connecting part of the attachment surface 5*b* is connected and attached to the image forming apparatus 1.

Figure 3:
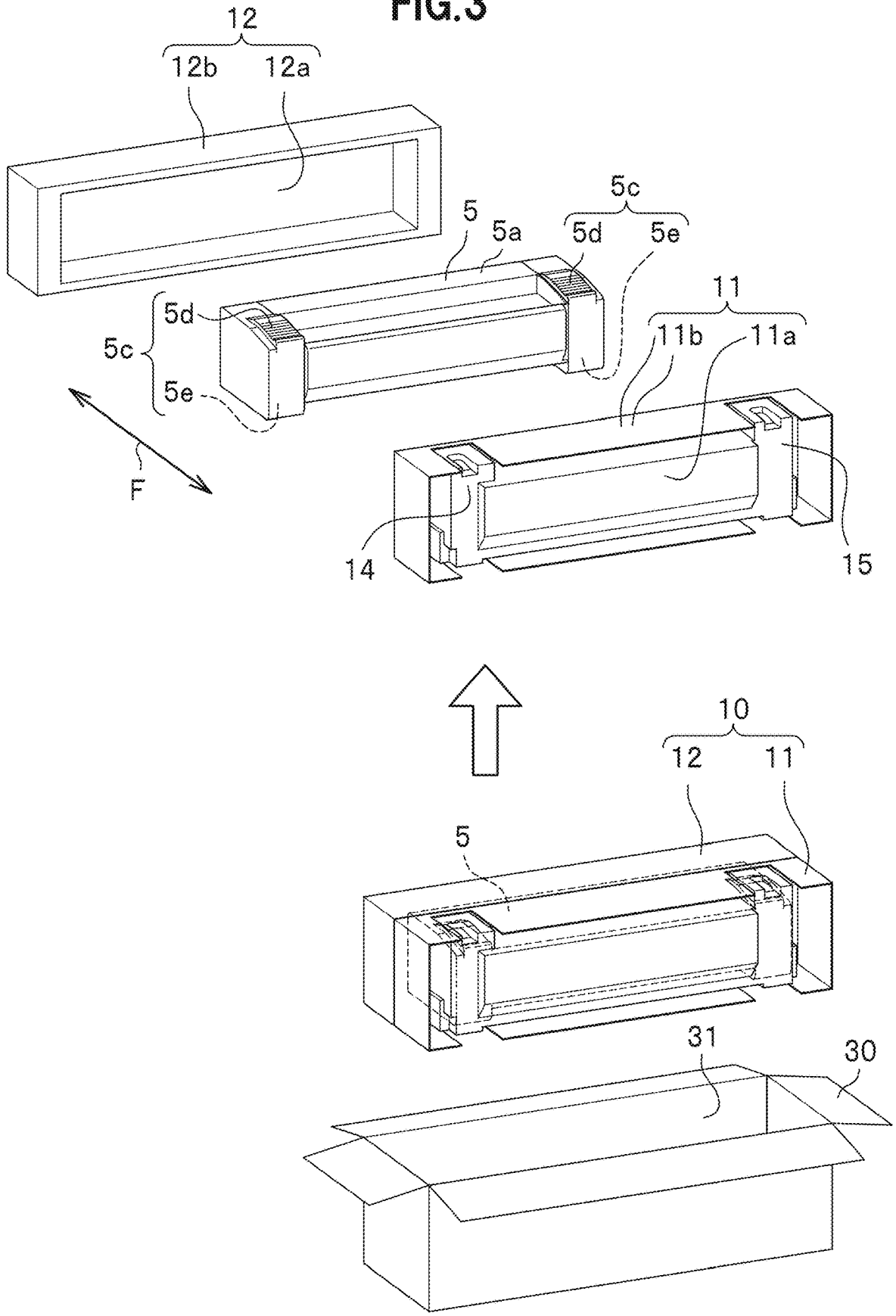
FIG. 3 is a perspective view for explaining a state in which the fixing device covered with the packing member are taken out from the box.

As illustrated in FIG. 3, a pair of gripped parts 5*c* is formed at the right and the left of a housing 5*a* of the fixing device 5. The gripped parts 5*c* are provided at the right and the left of end portions, respectively, in a right-left direction D. On upper and lower surfaces of outer walls of the gripped parts 5*c*, an upper surface part 5*d* and a lower surface part 5*e* are formed so as to be paired in the up-down direction H. Each of the upper surface part 5*d* and the lower surface part 5*e* of the embodiment 1 has an uneven non-slip shape alternately in the mounting direction F. The upper side surface part 5*d* and the lower surface part 5*e* of the gripped part 5*c* are formed at equal intervals with their out-of-plane directions being directed in the up-down direction H. Thus, when each of the gripped portion 5*c* is directly or indirectly held between fingers from above and below by a worker performing replacement work, the gripped part 5*c* is reliably gripped without slipping off.

Packing Member

As illustrated in FIG. 3, the packing member 10 includes an outer box 30 having a rectangular parallelepiped shape, and a first packing member 11 and a second packing member 12 that pack the fixing device 5 and store the fixing device 5 inside the outer box 30. The packing member 10 of the embodiment 1 includes a first packing member 11 and a second packing member 12 as another member. Among these, the first packing member 11 is configured to cover more than half of the fixing device 5 toward the front in the attachment direction F of the fixing device 5 (see FIG. 2). The second packing member 12 is formed of a member different from the first packing member 11. Thus, the first packing member 11 and the second packing member 12 are separable in the attachment direction F of the fixing device 5. The first packing member 11 and the second packing member 12 are abutted and combined with each other in the attachment direction F. Thus, an internal space for accommodating the fixing device 5 is formed inside the packing member 10 by the first packing member 11 and the second packing member 12.

Figure 4:
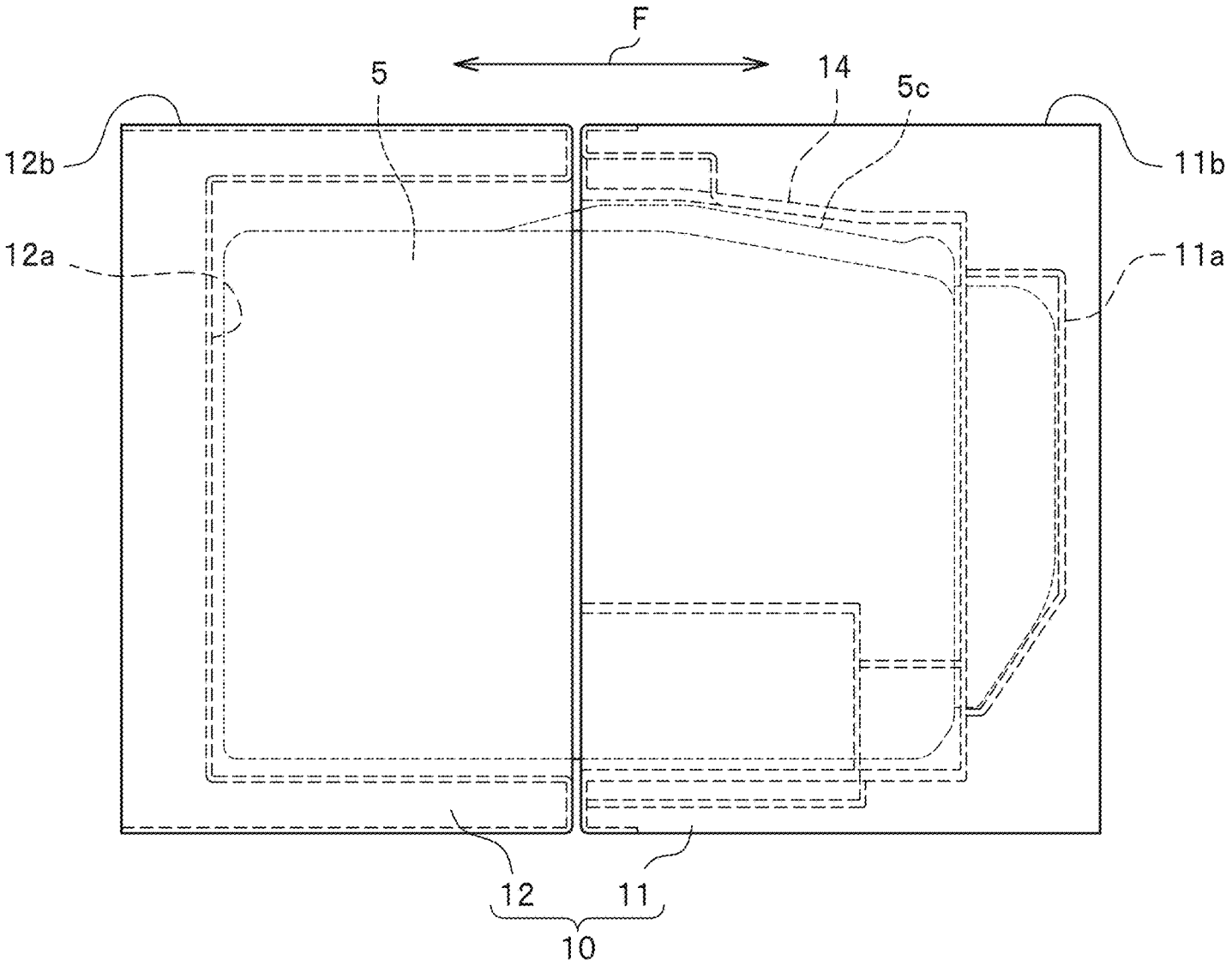
FIG. 4 is a side view of packing member combined in an attachment direction to cover a fixing device.

As shown in FIG. 4, the first packing member 11 of these includes a cover part 11*a* which covers the fixing device 5 in a state of being combined in the attachment direction F. The cover part 11*a* is formed in a bag shape which is convex rearward in the attachment direction F and is opened in a concave shape which is concave toward the second packing member 12. Then, the rear sections of the fixing device 5 is inserted into the cover part 11*a* through the opening in the attachment direction F (see FIG. 2). Thus, the fixing device 5 is accommodated in the internal space of the packing member 11 with half or more of the fixing device 5 covered with the cover part 11*a* in the attachment direction F.

Figure 5:
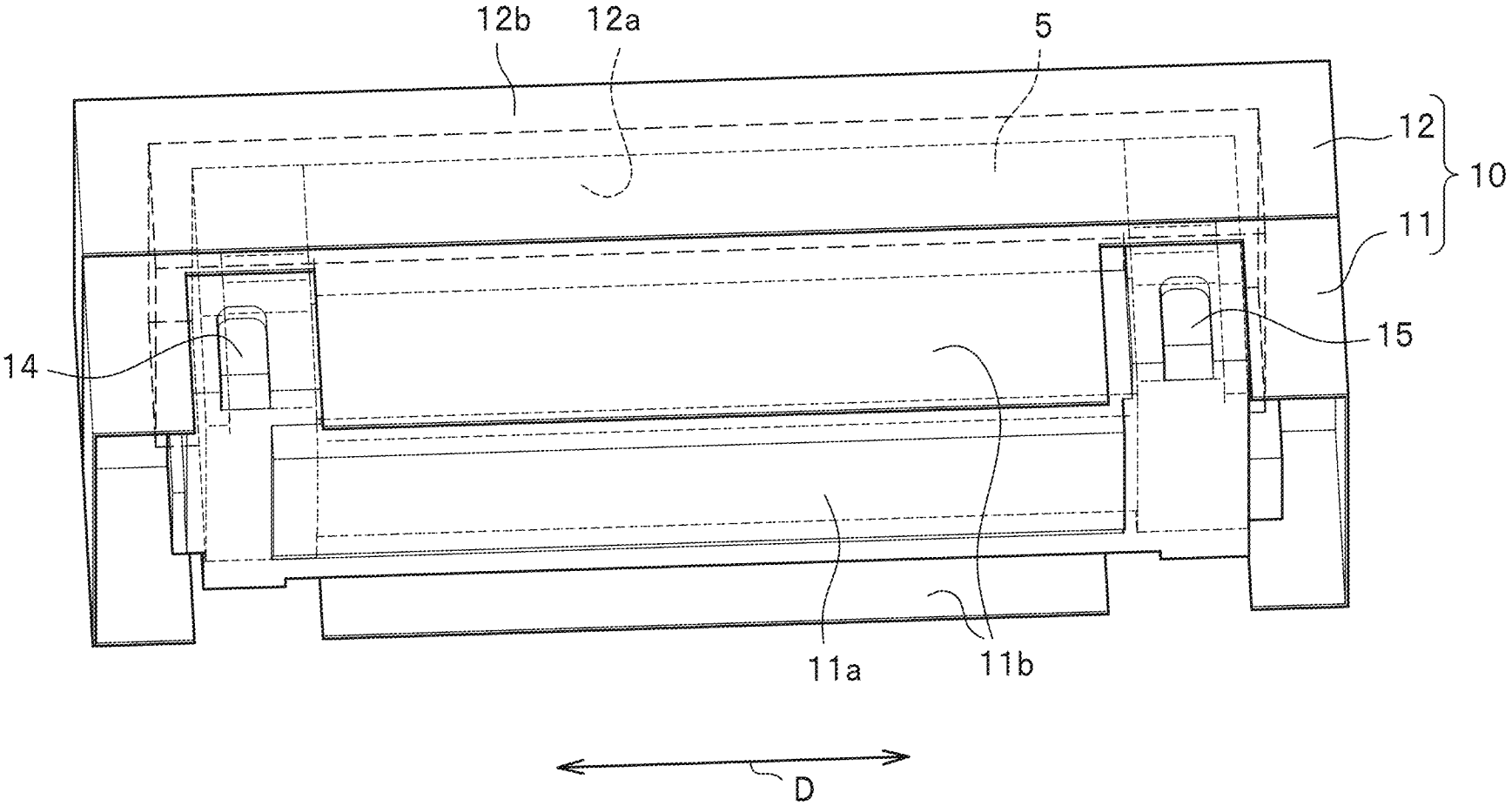
FIG. 5 is a perspective view showing a state in which the fixing device is wrapped with a packing member.

Further, as shown in FIG. 5, the first packing member 11 has flange part 11*b* which are provided around the cover part 11*a* and comes into contact with the inner side 31 of the outer box 30. Furthermore, the first packing member 11 has a left gripping part 14 and a right gripping part 15 provided in the vicinity of right end portion and left end portion of the cover part 11*a* respectively.

The cover part 11*a* of the embodiment 1 integrally connects the left gripping part 14 and the right gripping part 15 to each other while separating them from each other. That is, the left gripping part 14 and the right gripping part 15 are formed of the heat insulator having the same pulp mold as the cover part 11*a*. The pulp mold is a molded product molded a paper material, such as corrugated cardboard or waste paper of newspaper, as a main raw material. Therefore, in a manufacturing process when the first packing member 11 is manufactured by molding, the left gripping part 14 and the right gripping part 15 are integrally provided in the vicinity of right and left end portions of a cover section 11*a* respectively. Thus, the cover part 11*a*, the left gripping part 14 and the right gripping part 15 may be molded simultaneously in the step of molding the first packing member 11. Therefore, the manufacturing process of the left gripping part 14 and the right gripping part 15 is simplified.

Then, the left gripping part 14 and the right gripping part 15 are elastically deformed when a pressing force is applied in a direction in which the left gripping part 14 and the right gripping part 15 are compressed in the up-down direction H. The left gripping part 14 and the right gripping part 15 are pressed against respective outer walls of the left and right gripped parts 5*c* formed in the fixing device 5. Thus, a worker grips the respective gripped parts 5*c* via the left gripping part 14 and the right gripping part 15 without directly touching the gripped part 5*c*. In the embodiment 1, half or more of the fixing device 5 is inserted into the cover part 11*a* in the attachment direction F (refer to FIG. 2). The left gripping part 14 or the right gripping part 15 faces at an intermediate position of the fixing device 5 accommodated in the cover part 11*a* in the attachment direction F. Therefore, the upper surface part 5*d* and the lower surface part 5*e* of the gripped part 5*c* provided at the intermediate position are sandwiched in the up-down direction H by the left gripping part 14 and the right gripping part 15, respectively. Thus, the fixing device 5 is gripped at a well-balanced position in the attachment direction F.

Further, the flange part 11*b* has a vertical wall surface 11*e* and a flange surface 11*f* (see FIG. 2). Then, the front edge of the cover part 11*a* is connected to the flange surface 11*f* via the vertical wall surface 11*e*. The flange surface 11*f* is provided in a state of being separated from the periphery of the cover part 11*a* and comes in contact with the inner side 31 of the outer box 30. As a result, the flange part 11*b* is formed in a substantially horizontal U-shape which opens rearward in a cross-sectional shape in the attachment direction F.

The second packing member 12 further includes a cover part 12*a* for covering a smaller part of the fixing device 5 as compared with the first packing member 11, and a flange part 12*b* provided around the cover part 12*a* and contacting the inner side 31 of the outer box 30. The cover part 12*a* is formed in a bag shape that is convex forward in the attachment direction F. Thus, the cover part 12*a* of the second packing member 12 covers a part of the fixing device 5 toward the rear in the attachment direction F, that is, the remaining part that is not covered with the first packing member 11.

In the packing member 10 of the embodiment 1, the first packing member 11 and the second packing member 12 are combined together in the attachment direction F. Thus, an inner space for accommodating the fixing device 5 is formed inside the cover section 11*a* and the cover section 12*a*. The inner space of the embodiment has a dimension in the longitudinal direction similar to the dimension of the fixing device 5 in the left-right direction D. Then, the fixing device 5 is packed in a state where each surface of the outer walls of the fixing device 5 is covered with the cover part 11*a* of the first packing member 11 and the cover part 12*a* of the second packing member 12.

When the fixing device 5 is stored or transported, the fixing device 5 is covered with the cover part 11*a* and the cover part 12*a* and is put inside of the inner side 31 of the outer box 30 together with the first packing member 11 and the second packing member 12 (refer to FIG. 3). In a state where the first packing member 11 and the second packing member 12 are put in the outer box 30, the first packing member 11 and the second packing member 12 are interposed between an inner side 31 of the outer box 30 and respective outer walls of the housing 5*a* of the fixing device 5. Thus, the packing member 10 supports the fixing device 5 in a state in which the fixing device 5 is separated from the inner side 31 of the outer box 30, and functions as a buffer material for the fixing device 5. Therefore, the fixing device 5 is protected from external force such as a shock by the packing member 10 during transportation or storage.

The heat insulator constituting the first packing member 11 and the second packing member 12 has a thermal conductivity λ[W/m·K] of less than 2.0. The first packing member 11 and the second packing member 12 of the embodiment 1 are composed of pulp mold as a heat insulator. The thermal conductivity λ of the pulp mold is about the same as the thermal conductivity λ of 1.3 of the paper material, that is, λ of 1.2 to 1.4. Furthermore, the pulp mold used for the left gripping part 14 and the right gripping part 15 has recesses and projections like wrinkles formed on at least one of the surfaces. In this case, the thermal conductivity λ of the left gripping part 14 and the right gripping part 15 may be further reduced.

Preferably, the heat insulator is made of ceramic (including earthenware or porcelain), and may be used only for the left gripping part 14 and the right gripping part 15 to ensure desired deformability. Ceramic has a thermal conductivity λ of 1.0 to 1.6. Therefore. the thermal conductivity λ of the heat insulator can be less than 2.0.

Further, preferably, the thermal conductivity λ of the thermal insulator may be less than 1.0. For example, the heat insulator may be made of rubber, plastic, or the like. Rubber has a thermal conductivity λ of 0.13 to 0.20. The resin has a thermal conductivity λ of 0.13 to 0.67 (e.g., Bakelite (phenol resin) which is a thermosetting resin). Therefore. the thermal conductivity λ of the heat insulator may be set to less than 1.0. In the case where rubber or resin is used as the heat insulator, a material which is not melted by the heat of the fixing device 5, for example, another additive may be mixed with the rubber or resin.

More preferably, the thermal conductivity λ of the thermal insulator may be less than 0.06. For example, the heat insulator may be formed of a cloth material such as cotton or a paper material. Cotton has a thermal conductivity λ of 0.059. Further, regarding the paper material, the thermal conductivity λ of the heat insulator may be further reduced by containing a gas such as air having a further lower thermal conductivity λ. Therefore, by using a cloth material such as cotton, a paper material, or the like for at least part of the left gripping part 14 and the right gripping part 15, it is possible to easily set the heat conductivity λ to less than 0.06.

Figure 6:
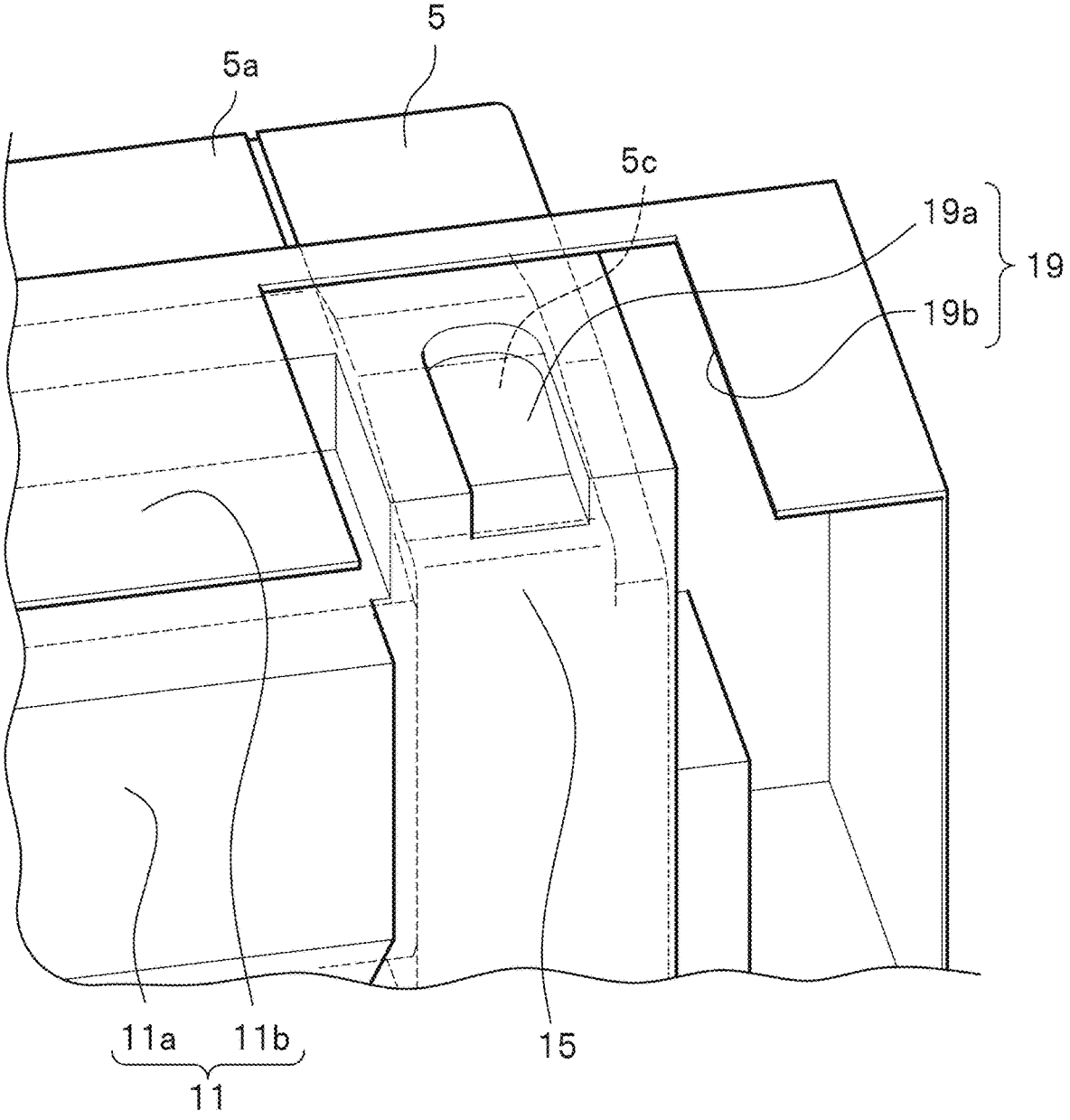
FIG. 6 is an enlarged view of a main part illustrating a mark of a packing member.

FIG. 6 illustrates the configuration of the right gripping part 15 of the first packing member 11. The left gripping part 14 of the first packing member 11 has a bilaterally symmetrical shape relative to a right gripping part 15. Therefore, the configuration of the right gripping part 15 will be mainly described herein, and a description on the left gripping section 14 will be omitted.

The left gripping part 14 and the right gripping part 15 respectively has a mark 19. The mark 19 of the embodiment 1 includes a finger placing recess section 19*a* which has a concave shape and a window section 19*b* formed by cutting out a part of a flange part 11*b* located outside the finger placing recess section 19*b*. Note that the mark 19 may be any one of the finger placing recess section 19*a* and the window section 19*b*. Further, the mark 19 may be configured to be different in color, texture, or material from the other parts except for the left gripping part 14 and the right gripping part 15 of the first packing member 11. Furthermore, the mark 19 may be formed by a combination of the finger placing recess section 19*a* or the window section 19*b* and different parts thereof.

Figure 7:
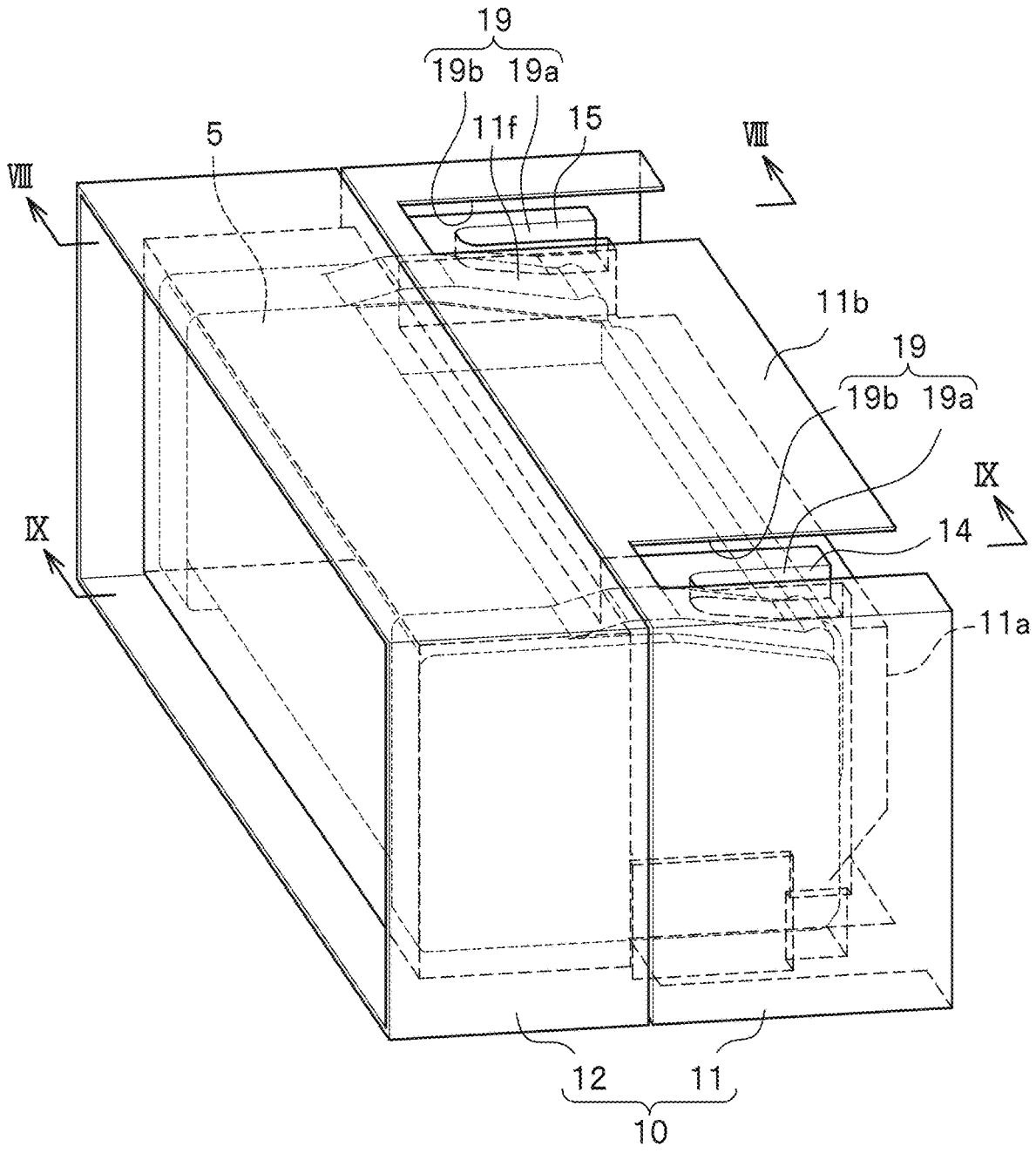
FIG. 7 is a perspective view of a packing member that wraps the fixing device.

The left gripping part 14 and the right gripping part 15 are distinguished from other constituent parts by these marks 19, and a position can be easily identified as to which part of the first packing member 11*a* worker should grip when performing maintenance work. As illustrated in FIG. 7, in the embodiment 1, the marks 19 are formed only on the left gripping part 14 and the right gripping part 15 of the first packing member 11. Therefore, a worker can more easily recognize that replacement work of the fixing device 5 is to be performed using the first packing member 11.

Figure 8:
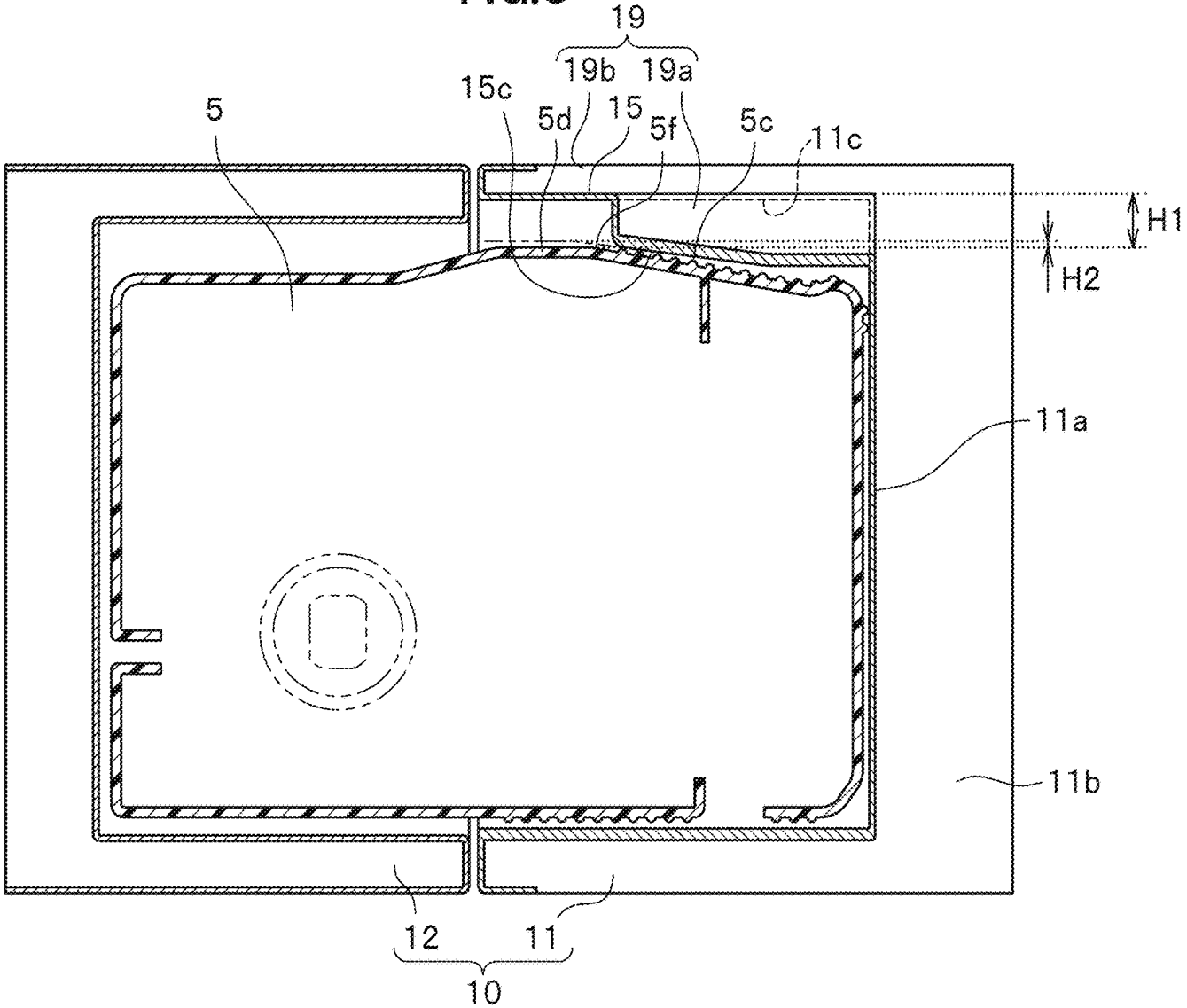
FIG. 8 is a cross-sectional view illustrating the position of the fixing device wrapped in the packing member, which is taken along line VIII-VIII in FIG. 7.

Furthermore, as illustrated in FIG. 8, regarding the right gripping part 15, a dimension between the inner \surface 11*c* of the cover part 11*a* and the upper surface part 5*d* of the outer wall of the fixing device 5 is set to be a dimension H1. The dimension H2 between the inner surface 15*c* of the right gripping part 15 and the outer wall 5*f* of the gripped part 5*c* is set to be smaller than the dimension H2(H1>H2).

Figure 9:
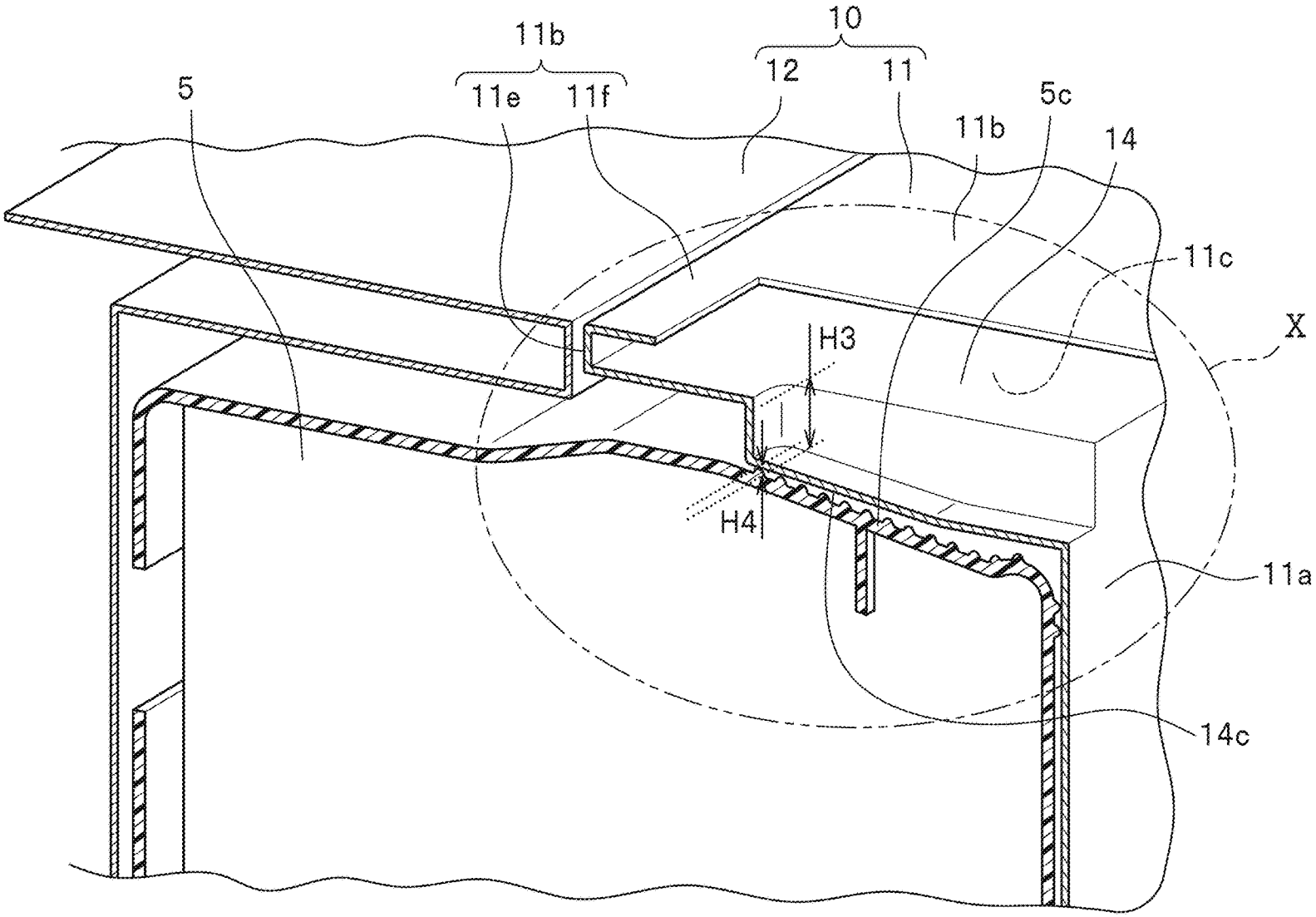
FIG. 9 is a cross-sectional view illustrating the position of the fixing device wrapped in a packing member, and is a cross-sectional view at a position taken along line IX-IX in FIG. 7.

Further, as shown in FIG. 9, in the left gripping part 14, a space between the inner surface 11*c* of the cover part 11*a* and the upper surface part 5*d* of the fixing device 5 is set to be a dimension H3. A dimension H4 between the inner surface 14*c* of the left gripping part 14 and the outer wall 5*f* of the gripped part 5*c* is set to be smaller than the dimension H3(H3>H4).

Further, in the embodiment 1, a dimension H1 is set between the fixing device 5 and a part of the cover part 11*a* that locates around where the right gripping part 15 is integrally provided. The dimension H1 is set to be equal size to the dimension H3 between the fixing device 5 and the cover part 11*a* that locates around where the left gripping part 14 is integrally provided. Furthermore, a dimension H2 between the right gripping part 15 and the fixing device 5 is set to be equal size to a dimension H4 between the left gripping part 14 and the fixing device 5. However, the present invention is not particularly limited thereto. For example, at least one of the dimensions H1 and H3 and at least one of the dimensions H2 and H4 may be set to be different.

Figure 10:
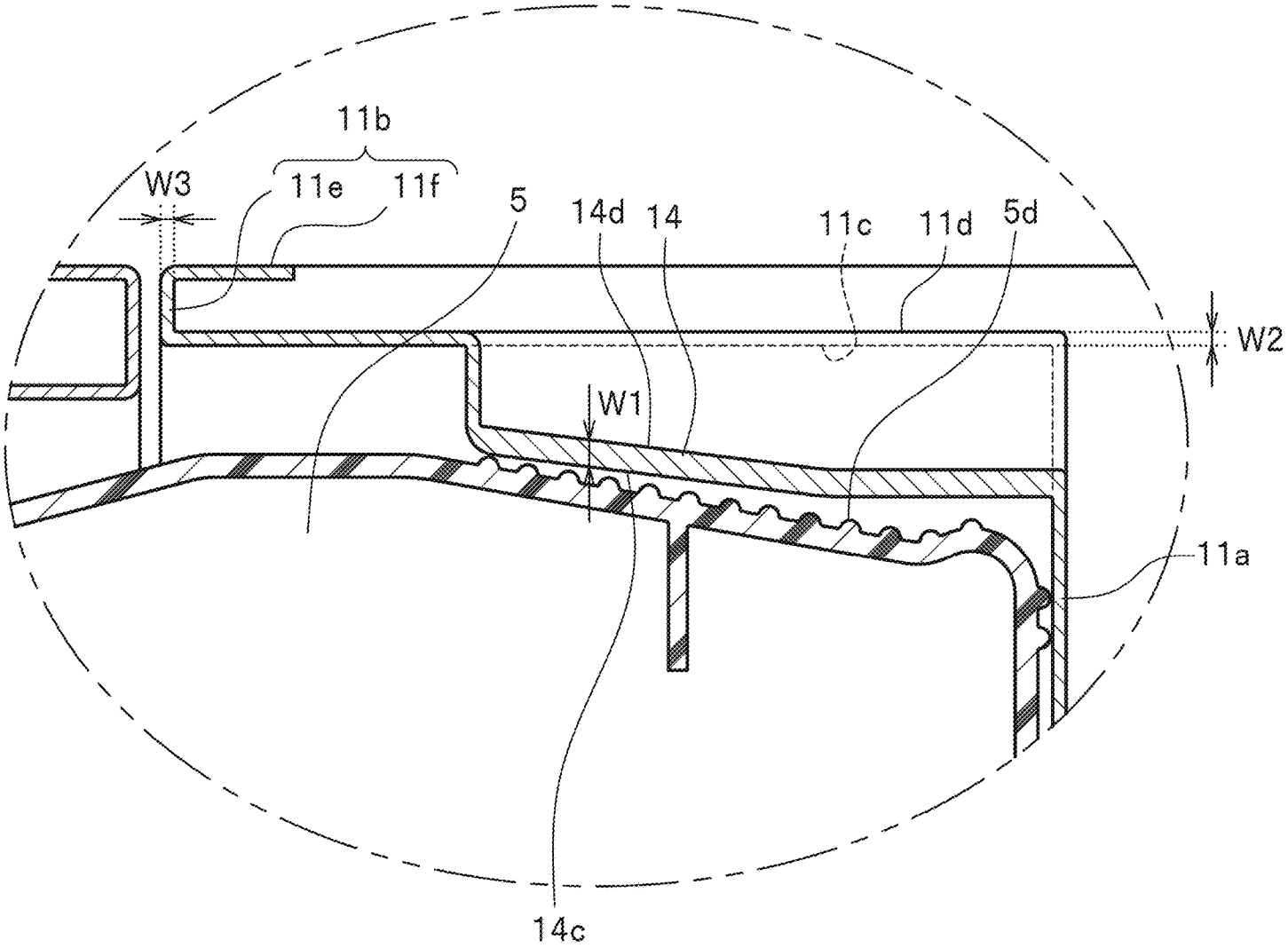
FIG. 10 is an enlarged cross-sectional view of a main part of a portion X in FIG. 9, illustrating an arrangement in which the fixing device and a part of the packing member are close to each other.

Further, in the embodiment 1, as shown in FIG. 10, the thickness dimension W2 is set between the inner surface 11*c* and the outer surface 11*d* of the cover part 11*a*, and a thickness dimension W3 is set on the vertical wall surface 11*e* of the flange part 11*b*. The thickness dimension W1 between the inner surface 14*c* and the outer surface 14*d* of the left gripping part 14 is set to be greater than at least one of the thickness dimension W2 and W3 (W2<W1, W3<W1). The thickness dimension between the inner surface and the outer surface of the right gripping part 15 is set in the same manner as the left gripping part 14.

As a result, the left gripping part 14 and the right gripping part 15 are insulated by the heat insulator having the desired thickness dimension W1, so that heat from the fixing device 5 is hardly transmitted to the worker who grips them. Further, even if the left gripping part 14 and the right gripping part 15 include the heat insulator having the desired thickness dimension W1 to insulate heat between the inner surface 11*c* and the outer surface 11*d*, the surrounding cover part 11*a* and flange part 11*b* are easily bent by the pressing force of the outer surface 11*d*. Therefore, with a small stroke (e.g., (H1>H2) illustrated in FIG. 8 and (H3>H4) illustrated in FIG. 9), the inner surfaces 14*c* and 15*c* respectively may come in contact and stick with pressure to gripped part 5*c*.

Figure 11:
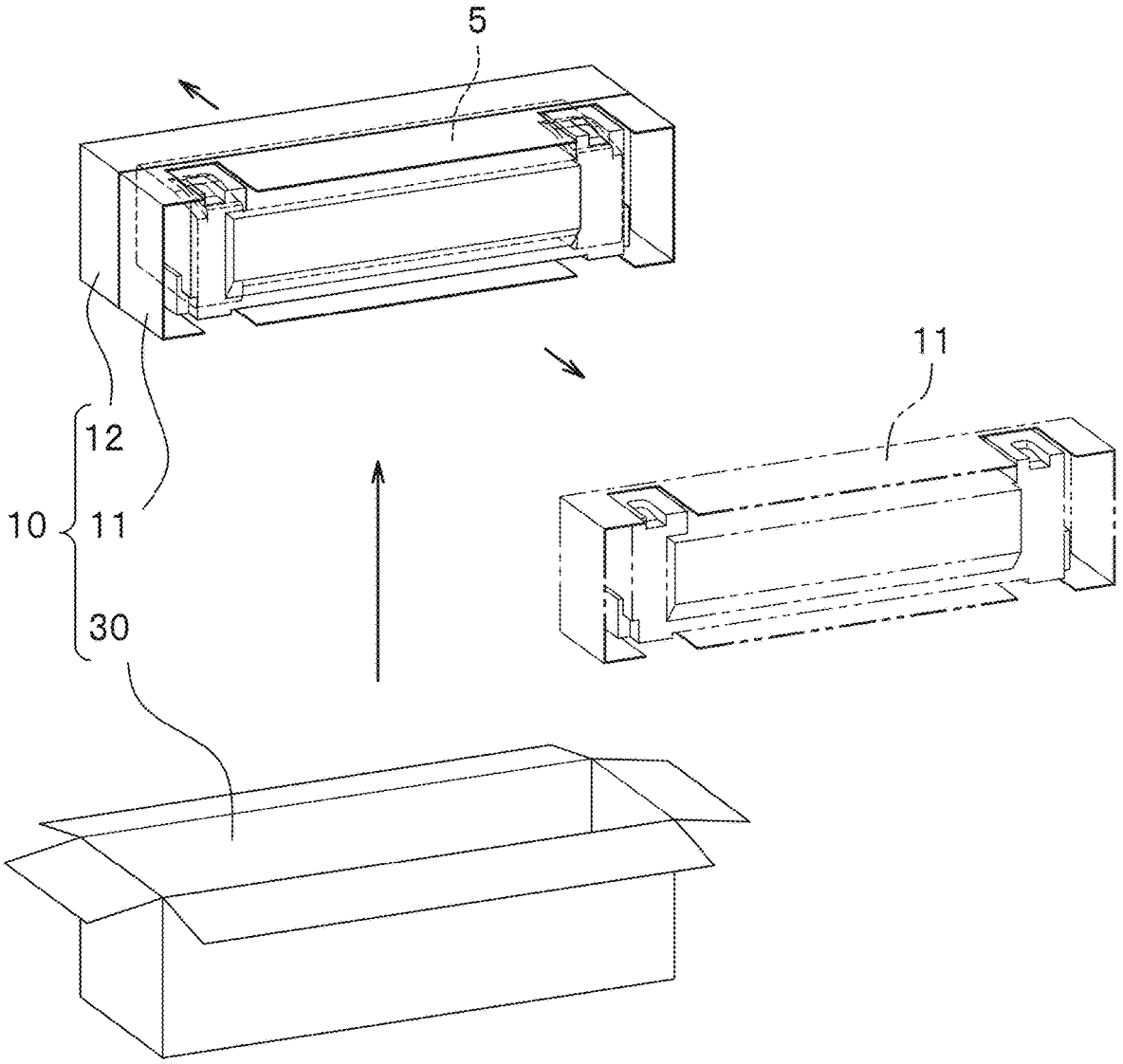
FIG. 11 is a perspective view illustrating replacement work of the embodiment 1 and illustrating a state of removing a first packing member.

FIGS. 11 to 17 illustrate maintenance work for replacing the fixing device 5 of the image forming apparatus 1 using the packing member 10 according to the embodiment 1. First, as shown in FIG. 11, the worker takes out the first packing member 11 and the second packing member 12 packing the new fixing device 5 from the outer box 30 of the packing member 10. Next, the first packing member 11 is separated from the second packing member 12 and the fixing device 5.

At this time, the worker distinguishes the positions of the left gripping part 14 and the right gripping part 15 from other constituent parts by the marks 19 (FIG. 6). Therefore, the worker can easily identify which part is to be gripped.

Figure 12:
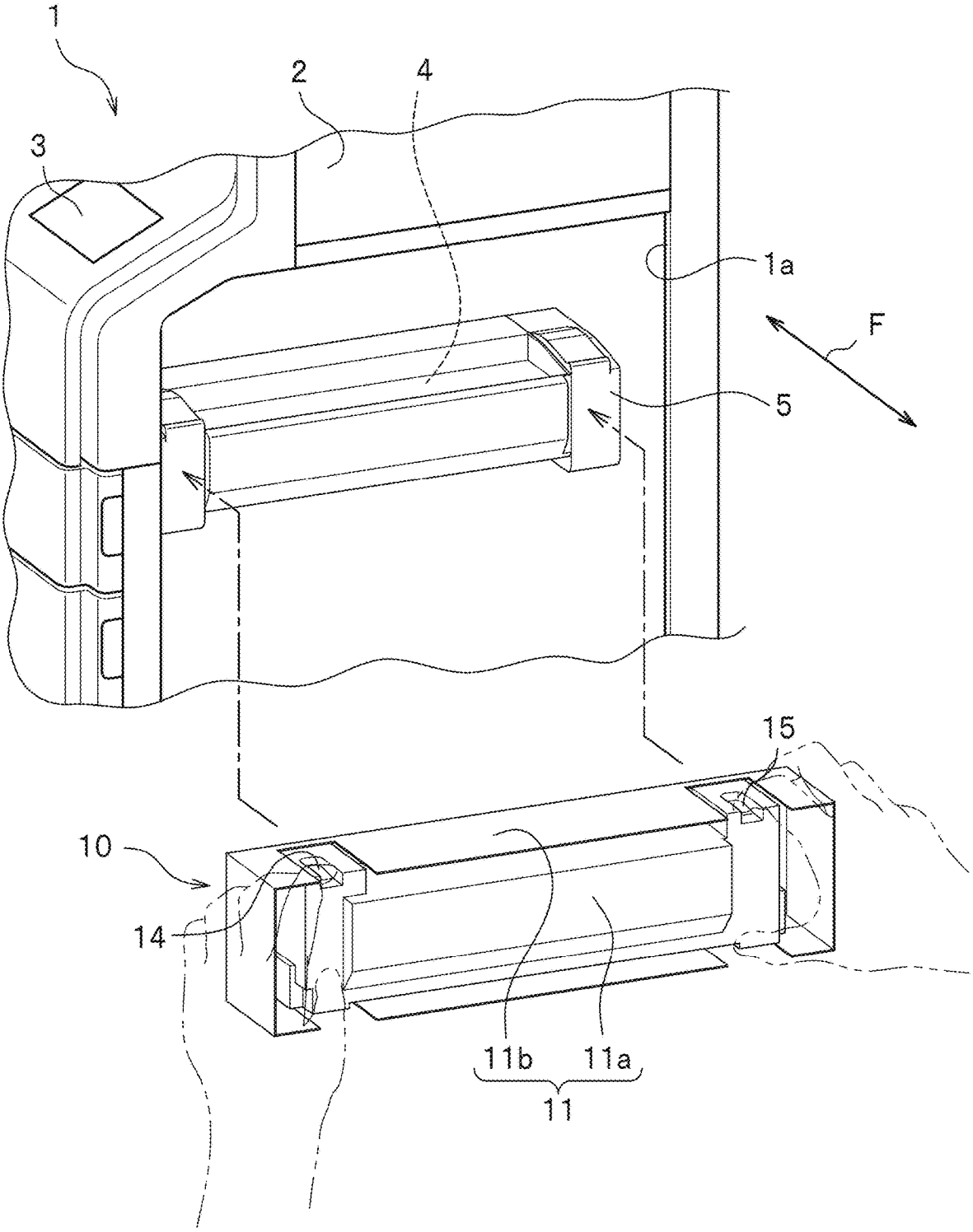
FIG. 12 is a perspective view illustrating a state in which a user covers a fixing device of the image forming apparatus with the first packing member.

FIG. 12 illustrates a state in which a cover body provided in the side part of the image forming apparatus 1 is opened. First, with respect to the used fixing device 5 mounted inside, a worker brings the first packing member 11 close to the maintenance opening 1*a* in the direction of the attachment direction F and inserts the first packing member 11 from the maintenance opening 1*a*. The replacement work may be started even in a state where the temperature of the fixing device 5 is still high, such as during continuous printing or immediately after the end of printing. Then, inside the maintenance opening 1*a*, the cover part 11*a* is put on the fixing device 5 attached to the attachment part 4. Note that the first packing member 11 was used for packing a new fixing device 5 having the same shape as the used fixing device 5. For this reason, the cover part 11*a* of the first packing member 11 covers half or more of the fixing device 5 from the rear to the front in the attachment direction F in conformity with the shape of the fixing device 5.

Figure 13:
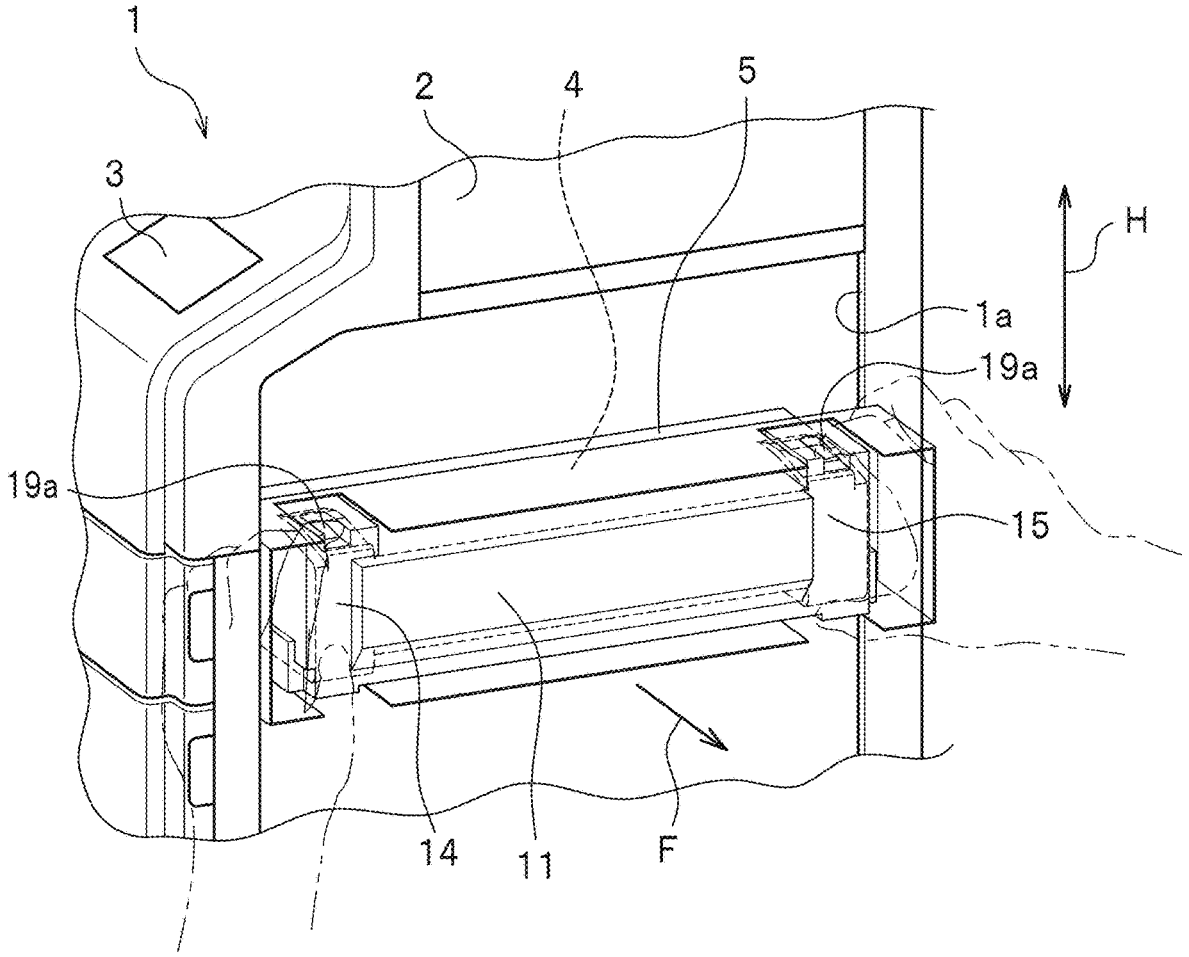
FIG. 13 is a perspective view illustrating a state in which a user covers the fixing device of the image forming apparatus with the first packing member and grips the fixing device covered with the first packing member.
Figure 14:
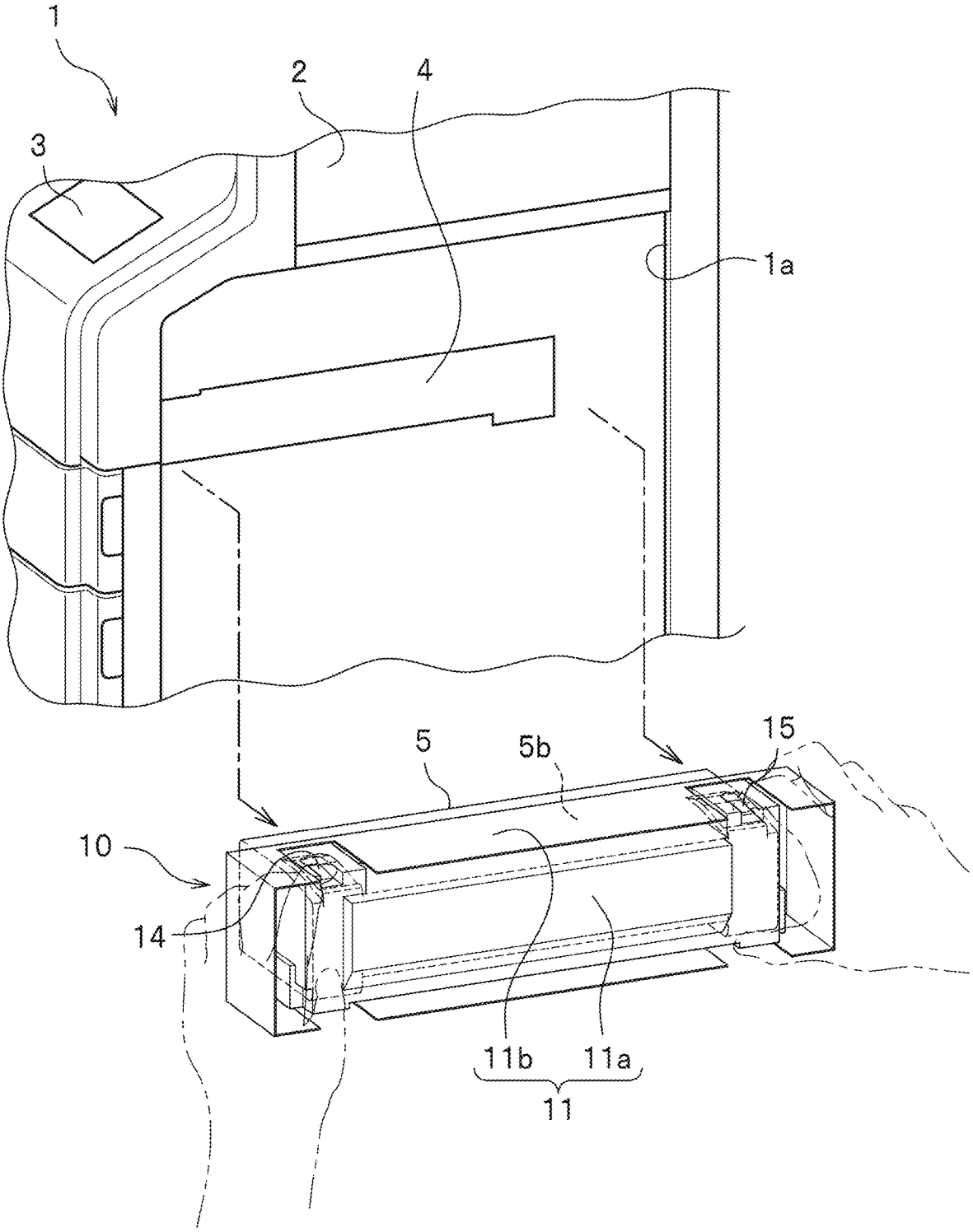
FIG. 14 is a perspective view illustrating a state in which a user grips and removes the fixing device from over the first packing member.

As illustrated in FIG. 13, a worker grips the used fixing device 5 from above the first packing member 11. The worker grips the left and right gripped part respectively from above and below in the up-down direction H by interposing the left gripping part 14 and the right gripping part 15 of the first packing member 11. At this time, the finger placing recess sections 19*a* (refer to FIG. 6) serving as the marks 19 of the left gripping part 14 and the right gripping part 15 are formed in a concave shape. Therefore, the worker can adjust his/her fingers to the finger placing recess sections 19*a* and, further, transmit the gripping force to the gripped parts 5*c* of the fixing device 5 from the left gripping part 14 and the right gripping part 15 efficiently.

In addition, the finger placing recess section 19*a* in a concave shape formed as the mark 19 is projectingly disposed on the gripped part 5*c*. Therefore, the dimensions H2 and H4 that are the dimensions between the inner surface 14*c*, 15*c* of the left gripping part 14 and the right gripping part 15 and the outer wall 5*f* of the gripped part 5*c* are further reduced as compared with the case where the finger placing recess section 19*a* is not formed. Thus, the innersurfaces 15*c* of the left gripping part 14 and the right gripping part 15 come in contact with the outer wall 5*f* of the gripped part 5*c* more easily by deformation. Therefore, the fixing device 5 is more reliably gripped from the outer surface 15*d* of the left gripping part 14 and the right gripping part 15.

Furthermore, the heat of the fixing device 5 is blocked by the pulp molds constituting the left gripping part 14 and the right gripping part 15 and is not easily transmitted to fingers and hands of the worker. In the embodiment 1, furthermore, a thickness dimension W1 that is between the inner surface 14*c* and the outer surface 14*d* of the left gripping part 14 or the like is set to be greater than those of other parts. Therefore, heat is less likely to be transmitted to the finger. Thus, as shown in FIG. 13, the worker can easily grip the gripped part 5*c* positioned right and the gripped part 5*c* positioned left by using the left gripping part 14 and the right gripping part 15, even when the temperature of the fixing device 5 is not sufficiently lowered.

In the embodiment 1, as shown in FIG. 10, the thickness dimension W1 of the left gripping part 14 and the right gripping part 15 is set to greater than the thickness dimension W2 of the cover part 11*a* or the thickness dimension W3 of flange part 11*b* (W2<W1, W3<W1). Therefore, the heat of the fixing device 5 is more effectively blocked by the pulp mold and is hardly transmitted to fingers or hands of the worker. In addition, the cover part 11*a* prevents the fixing device 5 from coming into direct contact with hands or clothes of the worker. Therefore, heat to the body of the worker other than the hand is blocked. Further, there is no possibility that the toner of the fixing device 5 adheres to the clothes of the worker. Therefore, it is possible to improve the workability in replacing the fixing device 5.

Further, the thickness dimension W2 of the cover part 11*a* or the thickness dimension W3 of the flange part 11*b* is smaller than the thickness dimension W1 of the left gripping part 14 and the right gripping part 15. Therefore, the area around the left gripping part 14 and the right gripping part 15 are easily deformed. Thus, regarding the left gripping part 14 and the right gripping part 15 facing the gripped part 5*c*, the inner surface 14*c* having a flat surface comes in contact with uneven slip stoppers of the gripped part 5*c* in a wide range. Therefore, replacement works are easily performed so that the fixing device 5 does not slip down. Therefore, workers can take the fixing device 5 out from the attachment part 4 of the image forming apparatus 1 by releasing the engagement of the attachment surface 5*b* of the fixing device 5 even in the middle of continuous printing or immediately after the end of printing.

At this time, an area between the left gripping part 14 and the right gripping part 15 is integrally connected by the cover section 11*a* formed of the same pulp mold as the left gripping part 14 and the right gripping part 15. Therefore, the fixing device 5 does not directly contact the worker. Thus, it is possible to safely remove the fixing device 5 having residual heat whose temperature has not been sufficiently lowered from the image forming apparatus 1. Further, there is no possibility that the toner of the fixing device 5 adheres to hands or clothes of the worker to stain the hands or clothes.

Figure 15:
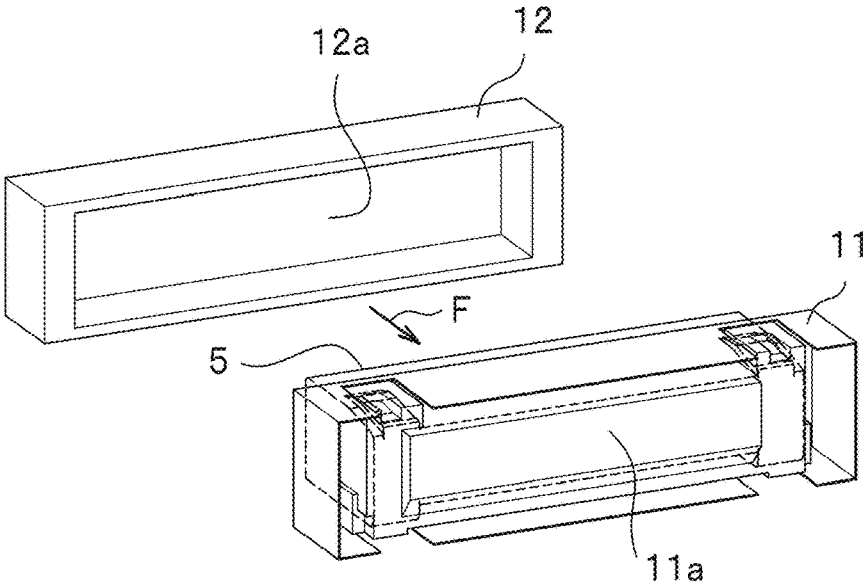
FIG. 15 is a perspective view illustrating a state in which the fixing device in the removed first packing member is covered with a second packing member.

As shown in FIG. 15, a worker covers the used fixing device 5 gripped from above the first packing member 11 with the second packing member 12 taken out from the outer box 30 in the attachment direction F. The used fixing device 5 is sandwiched between the first packing member 11 and the second packing member 12, and covered with the cover part 11*a* and the cover part 12*a*. At this time, the worker can perform a packing operation without directly contacting the fixing device 5 by holding the first packing member 11 and the second packing member 12. Therefore, even if residual heat remains in the fixing device 5, the fixing device 5 is accommodated in the internal space formed between the cover part 11*a* and the cover part 12*a*.

Figure 16:
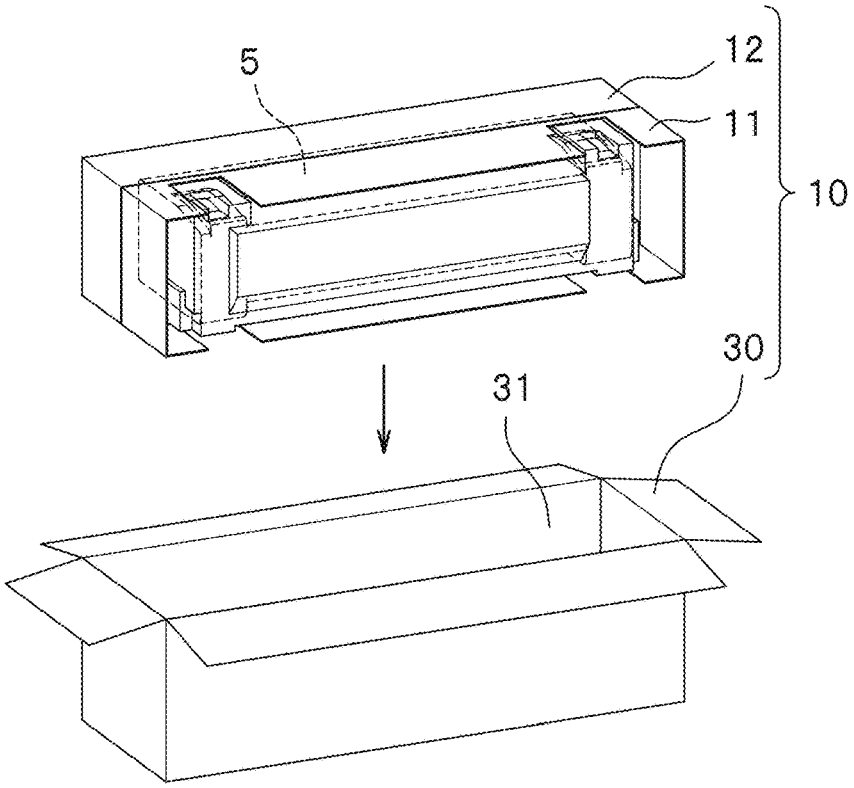
FIG. 16 is a perspective view illustrating a state in which the fixing device removed together with a packing member is accommodated in a box.

As shown in FIG. 16, the used fixing device 5 is put into the inner side 31 of the outer box 30 while being covered with the first packing member 11 and the second packing member 12. The upper opening of the outer box 30 is closed, and the outer box 30 is stored or transported until it is recycled or disposed.

Figure 17:
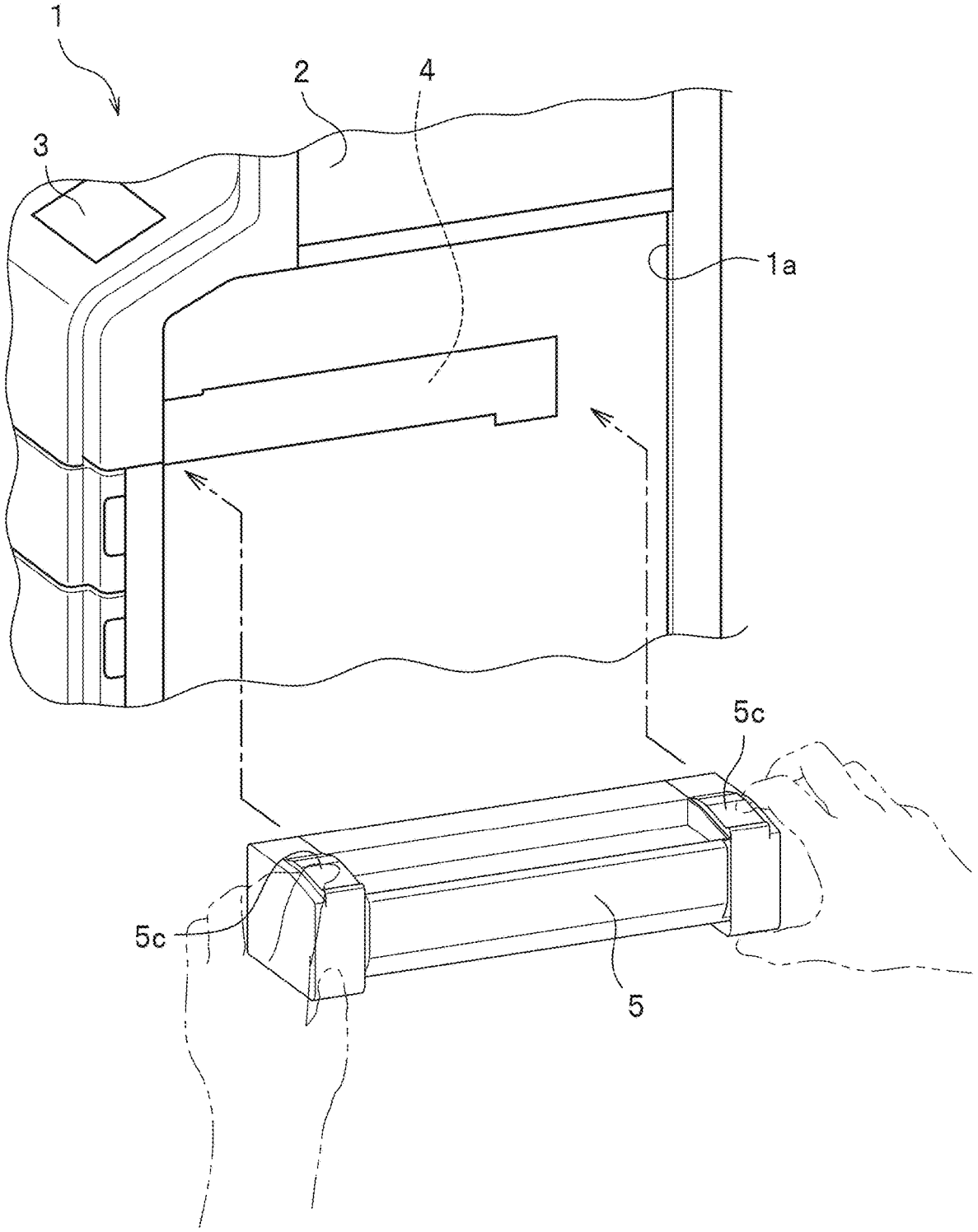
FIG. 17 is a perspective view illustrating a state in which a new fixing device is attached to the image forming apparatus.

Further, as illustrated in FIG. 17, a new fixing device 5 is attached to the attachment part 4 of the image forming apparatus 1. The new fixing device 5 is not heated and does not have heat. Therefore, a worker can directly grip the gripped part 5*c*, 5*c* of the fixing device 5 to attach the fixing device 5 to the image forming apparatus 1.

Figure 18:
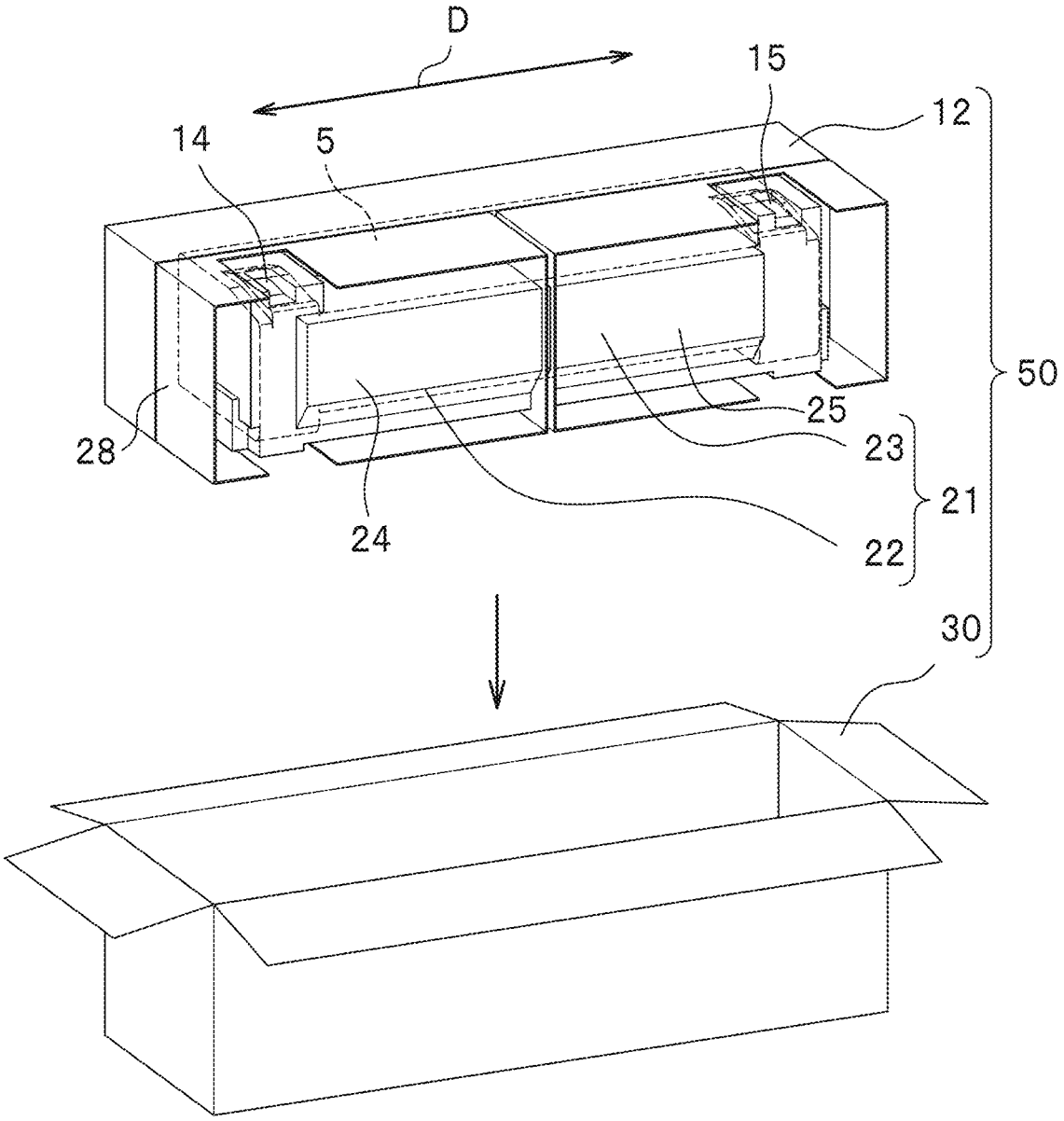
FIG. 18 is a perspective view illustrating the configuration of a packing member according to the embodiment 2 of the present invention.

FIG. 18 shows a packing member 50 according to the embodiment 2 of the present invention. Here, the description will be focused on the points of difference from the packing member 10 of the embodiment 1, and the same or equivalent portions will be denoted by the same reference signs, without description. In the packing member 50 according to the embodiment 2, a first packing member 21 includes a left first packing member 22 and a right first packing member 23 which are divided into two by the intermediate portion in the right-left direction D. The left first packing member 22 and the right first packing member 23 are provided with a left gripping part 14 and a right gripping part 15 so as to be integrated with a left cover part 24 and a right cover part 25, respectively. Among these, in the left cover part 24 and the right cover part 25 divided into two, a pair of a left gripping part 14 and a right gripping part 15 is provided in a state of separation from each other in the right-left direction D. From the area around left gripping part 14 and the area around the right gripping part 15, the left cover part 24 and the right cover part 25 which are formed of the same pulp mold as the left gripping part 14 and the right gripping part 15 extend toward the other of the right gripping part 15 and the left gripping part 14. The left first packing member 22 and the right first packing member 23 come in contact with each other at their ends facing each other in the divided portion.

The packing member 50 of the embodiment 2 thus configured has the left first packing member 22 and the right first packing member 23, which are obtained by dividing the first packing member 21 into two at the intermediate portion in the right-left direction D. Therefore, in addition to the effects of the packing member 10 of the embodiment 1, the packing member 50 of the embodiment 2 covers the fixing device 5 with the left first packing member 22 and the right first packing member 23 individually. Therefore, the workability in performing maintenance of the fixing device 5 is further improved.

The left first packing member 22 and the right first packing member 23 are also divided into two in the right-left direction D. The left cover part 24 extends from the area around the left gripping part 14 toward the right gripping part 15 located the other side. The right cover part 25 extends from the area around the right gripping part 15 toward the left gripping part 14 located the other side. Thus, when a worker takes the fixing device 5 out from the attachment part 4 while holding the left gripping part 14 with the left hand and the right gripping part 15 with the right hand, the worker does not directly contact the fixing device 5 in a heated state. The other configuration and operational effects are the same as those of the packing member 10 of the embodiment 1, and therefore, the description is omitted.

As described above, the packing member of the embodiments includes the cover part 11*a* for covering the fixing device 5. Further, the packing member includes a left gripping part 14 and a right gripping part 15 which are provided on both left and right sides of the cover part 11*a* and which grip a gripped part 5*c* formed in the fixing device 5. The packing members 10 and 50 configured as described above increase the utility value and improve the workability in replacing the fixing device 5.

That is, even when the temperature of the fixing device 5 is still high, for example, during continuous printing or immediately after the end of printing, a replacement of the used fixing device 5 with a new fixing device 5 and a quick restart of the next printing are allowed. Further, even a worker unfamiliar with the replacement work does not contact the fixing device 5. Therefore, there is no possibility that the toner of the fixing device 5 adheres to hands or the clothes and stains them.

In addition, the packing member packing the new fixing device can be used as it is to pack and transport the used fixing device. Therefore, the packing member that has become empty due to removal of a new fixing device is reused without being discarded, thereby improving the value of use. Therefore, the packing members 10 and 50 of the embodiments 1 and 2 exhibit good workability in replacement.

Further, in the packing member 10 of the embodiment 1, the thickness dimension W2 of the cover part 11*a* or the thickness dimension W3 of the flange part 11*b* is set smaller than the thickness dimension W1 of the left gripping part 14 and the right gripping part 15. Thus, the weight of the packing member 10 may be reduced as compared with a case where the packing member 10 is entirely constituted of the left gripping part 14 and the right gripping part 15 and the same thickness dimension W1. In addition, the amount of a material as a main raw material is reduced, which is a practically beneficial effect.

Although some embodiments of the present invention have been described above, these embodiments are merely examples and do not limit the technical scope of the present invention. The present invention can take other various embodiments, and furthermore, various changes such as omission and substitution can be made without departing from the spirit and scope of the present invention. These embodiments and modifications thereof are included in the scope and spirit of the invention described in the present specification and the like, and are also included in the invention described in the claims and the scope of equivalents thereof.

For example, although the embodiment has been described with reference to the left gripping part 14 and the right gripping part 15 provided in the vicinity of the left and right end portions, respectively, of the side of the cover part 11*a*, the present invention is not particularly limited thereto. For example, at least one gripping part may be provided at any part of the first packing member 11. In addition, the intermediate position may not be the center position at which the first packing member 11 is divided into two as long as it is between the right and left end portions of the first packing member 11. That is, the gripping part may be formed continuously with the cover part 11*a*. As described above, the shape, quantity, material, and formed position of the gripping part are not limited by the embodiment.

In addition, the mark 19 in the embodiments has a finger placing recess section 19*a* in a concave shape in each of the left gripping part 14 and the right gripping part and a window section 19*b* which is formed by cutting out a part of the flange part 11*b* located outside the finger placing recess section 19*a*. Furthermore, it has been described that the mark 19 may have a different color, texture, or material. However, the mark 19 is not particularly limited thereto. For example, one of the finger placing recess section 19*a* and the window section 19*b* may be provided. Furthermore, no mark 19 may be provided on the left gripping part 14 and the right gripping part 15. That is, the shape, quantity, material, color, and the like of the mark 19 are not limited to those in the embodiment.

Further, in the embodiments, as shown in FIG. 10, compared with at least one of the thickness dimension W2 between the inner surface 11*c* and the outer surface 11*d* of the cover part 11*a* and the thickness dimension W3 of the vertical wall surface 11*e* of the flange part 11*b*, the thickness dimension W1 between the inner surface 14*c* and the outer surface 14*d* of the left gripping part 14 is set to be greater (W2<W1, W3<W1). However, the present invention is not particularly limited thereto. For example, all the thickness dimension may be set to be the same (W1=W2, W3). That is, the sizes and positions of thickness dimension W1 to W3 may be set in any manner and are not limited to those described in the present embodiment.

Although embodiments of the present invention have been described and illustrated in detail, the disclosed embodiments are made for purposes of illustration and example only and not limitation. The scope of the present invention should be interpreted by terms of the appended claims.

What is claimed is:

1. A packing member and fixing device assembly, comprising:

a replacement fixing device that is configured to be detachable from and attachable to an image forming apparatus, and a packing member configured to at least partially cover the replacement fixing device within a box, wherein the packing member is configured to be interposed between a used fixing device mounted on the image forming apparatus and a user to allow the user to grip the used fixing device for replacement of the used fixing device with the replacement fixing device.

2. The packing member and fixing device assembly according to claim 1, wherein the packing member comprises:

a cover part configured to be able to at least partially cover the used and replacement fixing-devices, wherein the cover part has a gripping part defined by at least a part of the cover part and configured to engage with a counterpart gripped part formed in the used fixing device so as to allow the user to grip the gripped part.

3. The packing member and fixing device assembly according to claim 2, wherein the gripping part includes a heat insulator for insulating heat generated by the used fixing device when the gripping part is engaged with the gripped part of the used fixing device by application of pressure by the user to the gripping part for replacement of the used fixing device with the replacement fixing device.

4. The packing member and fixing device assembly according to claim 3, wherein the heat insulator has a thermal conductivity λ[W/m·K] of less than 2.0.

5. The packing member and fixing device assembly according to claim 4, wherein the heat insulator has a thermal conductivity λ[W/m·K] of less than 1.0.

6. The packing member and fixing device assembly according to claim 5, wherein the heat insulator is made of a pulp mold.

7. The packing member and fixing device assembly according to claim 4, wherein the heat insulator is made of a pulp mold.

8. The packing member and fixing device assembly according to claim 3, wherein the heat insulator has a thermal conductivity λ[W/m·K] of less than 0.06.

9. The packing member and fixing device assembly according to claim 8, wherein the heat insulator is made of a pulp mold.

10. The packing member and fixing device assembly according to claim 3, wherein the heat insulator is made of a pulp mold.

11. The packing member and fixing device assembly according to claim 3, wherein a dimension between an inner surface of the gripping part and an outer wall of the gripped part is set to be smaller than a dimension between an inner surface of the cover part and an outer wall of the used or replacement fixing device.

12. The packing member and fixing device assembly according to claim 3, wherein a thickness dimension between an inner surface and an outer surface of the gripping part is set to be greater than a thickness dimension between an inner surface and an outer surface of the cover part.

13. The packing member and fixing device assembly according to claim 2, wherein the cover part has a pair of gripping parts spaced apart from each other, and the cover part integrally extends between the pair of the gripping parts.

14. The packing member and fixing device assembly according to claim 2, wherein the cover part has a pair of gripping parts spaced apart from each other and the cover part provided around one of the pairs of the gripping parts extends toward the other one of the pairs of the gripping parts.

15. The packing member and fixing device assembly according to claim 2, wherein the gripping part has a distinguishing mark to allow the user to notice the location of the gripping part on the cover part.

16. The packing member and fixing device assembly according to claim 15, wherein gripping part is defined by having a concave shape and the distinguishing mark is a finger placing recess section in the concave shape.

17. The packing member and fixing device assembly according to claim 15, wherein the distinguishing mark is a window section defined as a cutout which is formed in the cover part.

18. The packing member and fixing device assembly according to claim 15, wherein the distinguishing mark is different in color, texture, or material from other areas of the cover part.

19. The packing member and fixing device assembly according to claim 2, wherein the cover part is a part of a first packing member to cover half or more of the replacement fixing device in an attachment direction of the replacement fixing device, and the packing member additionally comprises a second packing member configured to be separated from the first packing member in the attachment direction of the replacement fixing device and configured to cover a smaller part of the replacement fixing device than the first packing member.

* * * * *